US007720430B2

(12) United States Patent
Hasegawa et al.

(10) Patent No.: US 7,720,430 B2
(45) Date of Patent: May 18, 2010

(54) IMAGE FORMING APPARATUS

(75) Inventors: Makoto Hasegawa, Kasugai (JP); Fumio Morita, Ichinomiya (JP); Tomitake Aratachi, Nagoya (JP); Masamitsu Ukai, Nagoya (JP); Yoshinori Ito, Toyokawa (JP); Takashi Shimizu, Kakamigahara (JP); Takuro Kusama, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 629 days.

(21) Appl. No.: 11/256,644

(22) Filed: Oct. 20, 2005

(65) Prior Publication Data

US 2006/0099004 A1 May 11, 2006

(30) Foreign Application Priority Data

Oct. 20, 2004 (JP) ..... P2004-305548
Jan. 31, 2005 (JP) ..... P2005-024226

(51) Int. Cl.
*G03G 15/00* (2006.01)

(52) U.S. Cl. ..... 399/397; 399/92; 399/315; 399/400

(58) Field of Classification Search ..... 399/92, 399/400, 315, 397
See application file for complete search history.

(56) References Cited

U.S. PATENT DOCUMENTS 4,223,993 A * 9/1980 Tsuda et al.
4,338,017 A * 7/1982 Nishikawa
5,477,314 A * 12/1995 Tsuchiya et al.
5,926,683 A * 7/1999 Yuminamochi et al. ..... 399/315
6,219,505 B1 4/2001 Sato et al.
2001/0031154 A1 10/2001 Sato et al.
2003/0049043 A1 3/2003 Fuwazaki et al.
2007/0026705 A1 2/2007 Tyler

FOREIGN PATENT DOCUMENTS

JP 6027844 2/1994
JP 7237777 9/1995
JP 07319298 A * 12/1995

(Continued)

OTHER PUBLICATIONS

Machine Translation of JP Pub. 2002-072696.*

(Continued)

*Primary Examiner*—David M Gray
*Assistant Examiner*—Laura K Roth
(74) *Attorney, Agent, or Firm*—Darby & Darby P.C.

(57) ABSTRACT

An image forming apparatus includes: an image carrier that carries a developer image; a transfer member that transfers the developer image carried on the image carrier onto an image forming surface of a recording medium being conveyed; a fixation member that is disposed downstream of the transfer member in a conveyance direction of the recording medium, and fixes the developer image transferred on the recording medium; a first member that is disposed between the transfer member and the fixation member to face the image forming surface of the recording medium; and a second member that is disposed between the transfer member and the fixation member to face a non-image forming surface that is opposite the image forming surface, wherein the first member is provided with a first electrically-conductive member having an electric conductivity and being grounded.

32 Claims, 22 Drawing Sheets

FOREIGN PATENT DOCUMENTS

| | | | |
|---|---|---|---|
| JP | 9106239 | | 4/1997 |
| JP | 09134103 | A | 5/1997 |
| JP | 10-232570 | A | 9/1998 |
| JP | 2000194241 | A | 7/2000 |
| JP | 2000-227743 | | 8/2000 |
| JP | 2001-154495 | A | 6/2001 |
| JP | 2002-072696 | A | 3/2002 |
| JP | 2002-328552 | A | 11/2002 |

OTHER PUBLICATIONS

Patent Abstracts of Japan for JP2002-328552 published Nov. 15, 2002.

Patent Abstracts of Japan for JP2001-154495 published Jun. 8, 2001.

Patent Abstracts of Japan for JP2002-072696 published Mar. 12, 2002.

Patent Abstracts of Japan for JP10-232570 published Sep. 2, 1998.

Translation of Notification of Reasons for Refusal mailed Sep. 29, 2009 in connection with corresponding Japanese Patent Application No. 2005-024226.

* cited by examiner

IMAGE FORMING APPARATUS

BACKGROUND

1. Field

The present invention relates to an image forming apparatus.

2. Related Art

Heretofore, in a laser printer, there has been provided a configuration wherein an electrically conductive member is disposed on the side of the non-image-forming surface of paper (a recording medium) in the conveyance path between transfer member and fixation member. A patent document JP-A-2002-328552, for example, discloses a configuration wherein the electrically conductive member (conveyance metal plate) which is earthed (grounded) to a conveyance guide (guide member) arranged on the side of the non-image-forming surface is disposed. According to the configuration, an appropriate potential difference can be established between the paper (recording medium) charged during transfer and the conveyance guide (guide member) arranged on the side of the non-image-forming surface of the paper, so that the paper can be stably conveyed.

Meanwhile, in the field of image forming apparatuses, a request for the reduction of a size has been more eagerly made at present. When the reduction of the size of the whole apparatus is to be realized for the purpose of meeting the request, various components need to be arranged more densely, and various members concentrate also in the vicinity of a conveyance path which is constructed between transfer member and fixation member. In such a situation, when the various members are charged, there is the problem that the behavior of the recording medium being conveyed cannot be stably controlled by the prior-art configuration wherein only the members on the side of the non-image-forming side of the recording medium are merely grounded. More specifically, in the case where the reduction of the size is intended, not only the members on the side of the non-image-forming surface of the recording medium, but also the members on the side of the image forming surface thereof need to be arranged nearer to the recording medium being conveyed, and hence, the problem occurs anew that the charging of the members on the side of the image forming surface become liable to exert influence on the behavior of the recording medium.

SUMMARY

The present invention provides an image forming apparatus having a configuration in which the charging of members disposed on the side of the image forming surface of a recording medium, between transfer member and fixation member, can be restrained from acting on the recording medium, so as to stably control the behavior of the recording medium.

An image forming apparatus includes: an image carrier that carries a developer image; a transfer member that transfers the developer image carried on the image carrier onto an image forming surface of a recording medium being conveyed; a fixation member that is disposed downstream of the transfer member in a conveyance direction of the recording medium, and fixes the developer image transferred on the recording medium; a first member that is disposed between the transfer member and the fixation member to face the image forming surface of the recording medium; and a second member that is disposed between the transfer member and the fixation member to face a non-image forming surface that is opposite the image forming surface, wherein the first member is provided with a first electrically-conductive member having an electric conductivity and being grounded.

BRIEF DESCRIPTION OF THE DRAWINGS

In the accompanying drawings:

FIG. 12A is a view of the process cartridge as seen from the side of a fixation portion, while

DETAILED DESCRIPTION OF THE EMBODIMENTS

Embodiment will be described below with reference to the drawings.

First Embodiment

A first embodiment of the present invention will be described.

Figure 1:
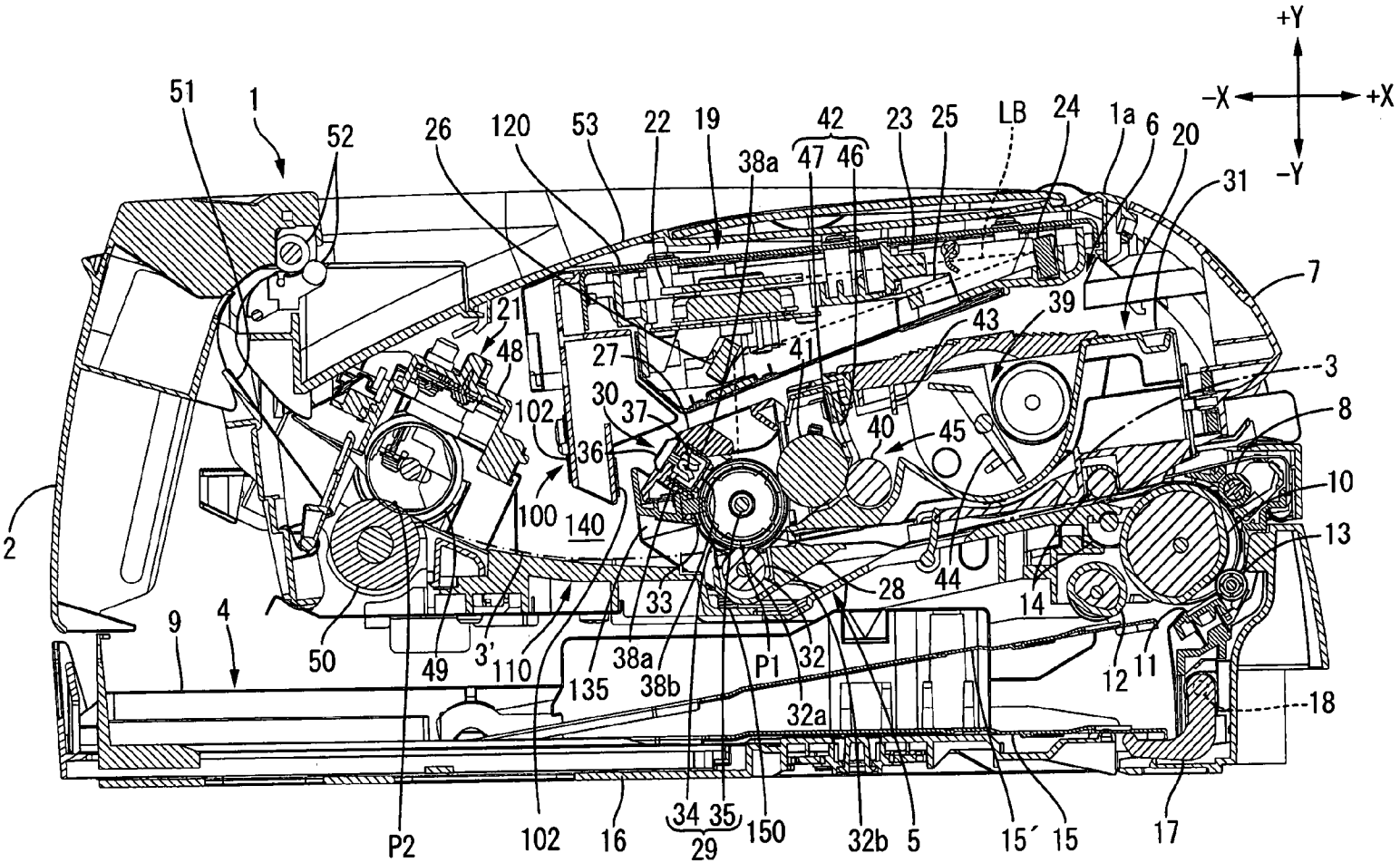
FIG. 1 is a side sectional view of essential portions showing one configuration of a laser printer according to a first embodiment of the image forming apparatus.
Figure 2:
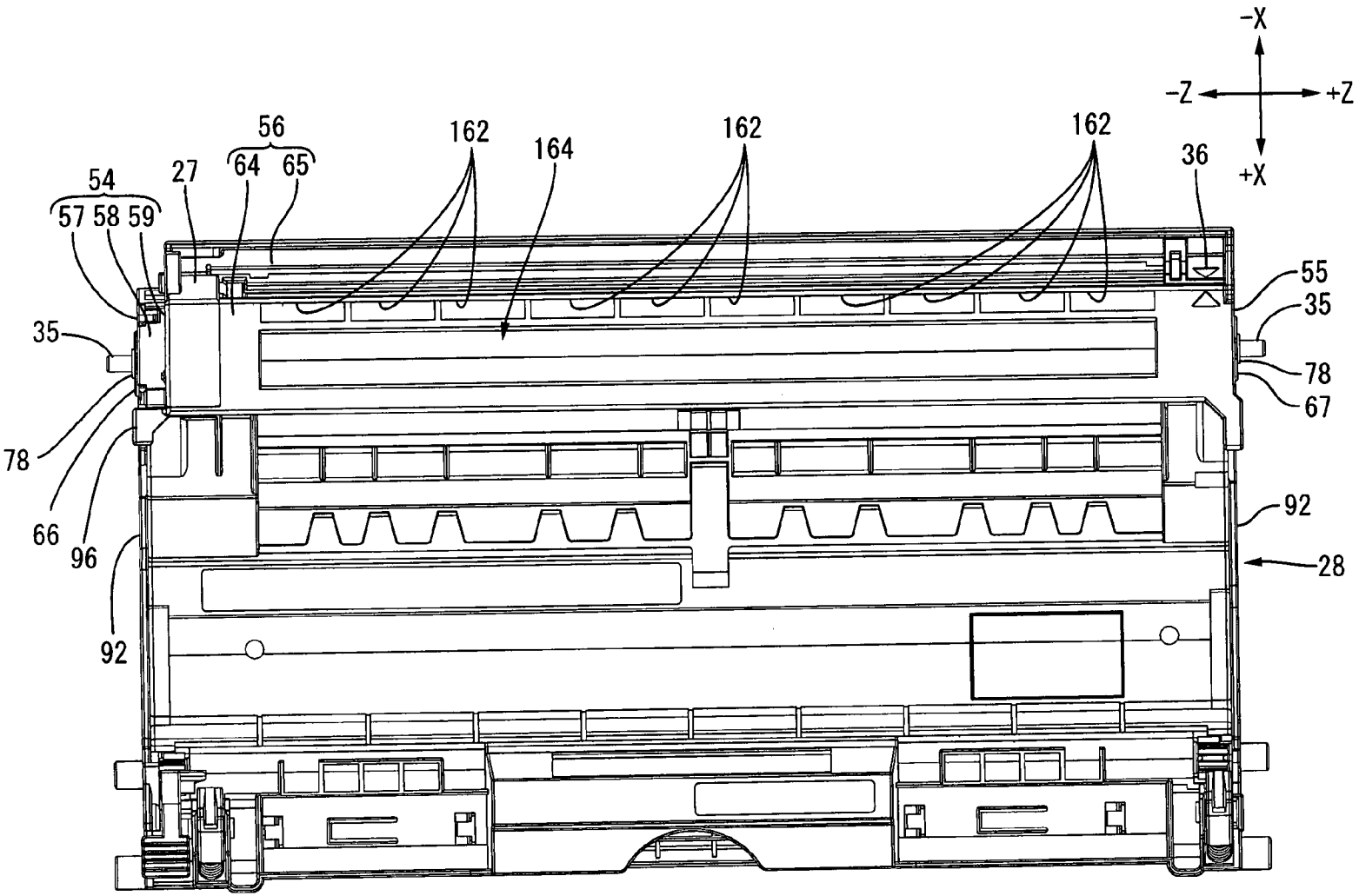
FIG. 2 is a plan view showing the part of a process cartridge except a development cartridge.
Figure 3:
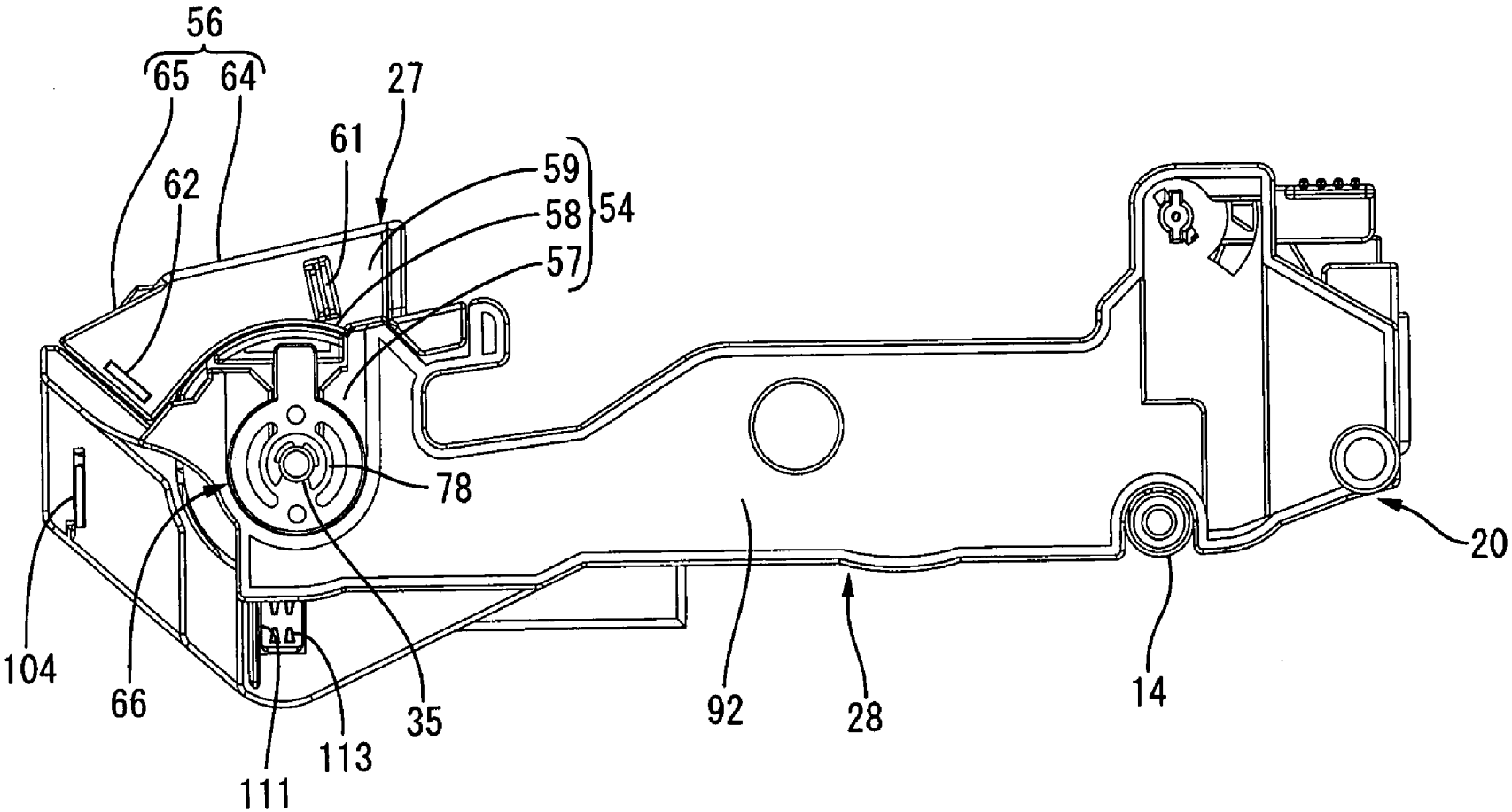
FIG. 3 is a side view of the part shown in FIG. 2.
Figure 4:
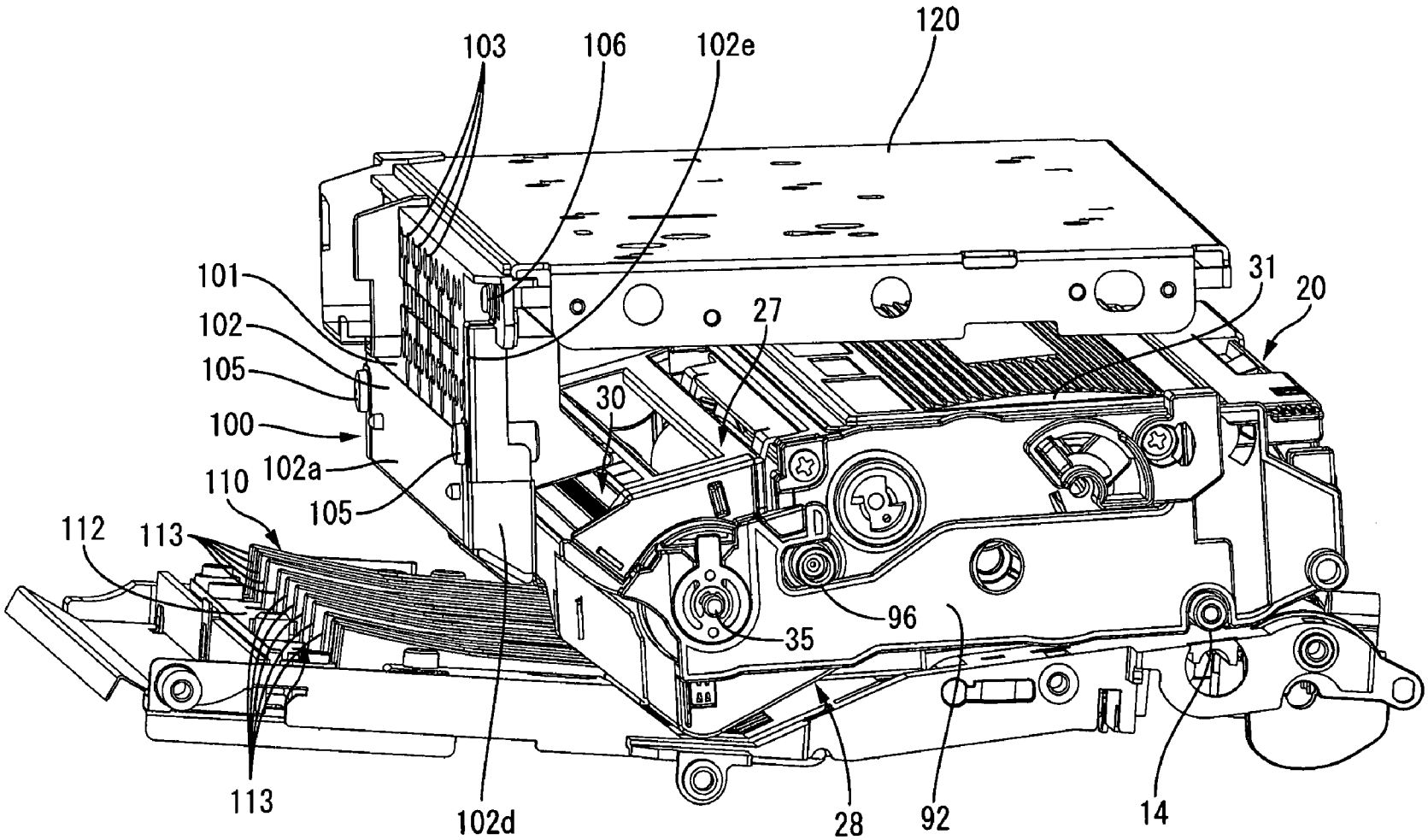
FIG. 4 is a perspective view showing the arrangement of the process cartridge, a duct and a guide member in the laser printer.

First, the general configuration of a laser printer according to the first embodiment will be described with reference to FIGS. 1 through 4. FIG. 1 is the side sectional view of essential portions showing one embodiment of a laser printer which is the image forming apparatus of the invention. FIG. 2 is a plan view showing the part of a process cartridge except a development cartridge, and FIG. 3 is the side view of the part. Besides, FIG. 4 is a perspective view showing the arrangement of the process cartridge, a duct and a guide member in the laser printer.

The laser printer 1 includes a body casing 2, and a feeder section 4 for feeding paper 3 as a recording medium, an image formation section 5 for forming an image on the fed paper 3, which are accommodated in the body casing 2.

An attachment/detachment opening 6 for attaching and detaching the process cartridge 20 to be stated below is formed in the sidewall of one side of the body casing 2, and a front cover 7 for opening and closing the attachment/detachment opening 6 is provided. The front cover 7 is turnably supported on a cover shaft (not shown) which is inserted through the lower end part thereof. Thus, when the front cover 7 is closed about the cover shaft, the attachment/detachment opening 6 is closed by the front cover 7 as shown in FIG. 1, and when the front cover 7 is opened (inclined down) with the cover shaft as a fulcrum, the attachment/detachment opening 6 is opened, and the process cartridge 20 can be attached to or detached from the body casing 2 through the attachment/detachment opening 6. By the way, in the laser printer 1, a body part except the process cartridge 20 is an apparatus body 1*a*. In this embodiment, the process cartridge 20 including various components such as a photosensitive member 29 is configured so as to be attachable to and detachable from the apparatus body 1*a*, and the practicable configuration of the process cartridge 20 will be stated later.

In the first embodiment, a side on which the front cover 7 is disposed as viewed in FIG. 1 shall be termed "front side", and the opposite side "rear side". In the ensuing description, the front and rear direction of the laser printer 1 shall be taken as an "X-axial direction", the height direction of the laser printer 1 as a "Y-axial direction", and the widthwise direction of the paper being conveyed as a "Z-axial direction".

The feeder section 4 includes at a bottom part in the body casing 2, a paper feed tray 9 which is dismountably mounted, a feed roller 10 and a separation pad 10 which are disposed above the front end part of the paper feed tray 9, a pickup roller 12 which is disposed on the rear side of the feed roller 10, a pinch roller 13 which is arranged below the front side of the feed roller 10 in opposition to this feed roller, a paper-powder removal roller 8 which is arranged above the front side of the feed roller 10 in opposition to this feed roller, and registration rollers 14 which are disposed above the rear side of the feed roller 10.

Included inside the paper feed tray 9 is a paper presser plate 15 on which the sheets of paper 3 can be placed in stacked fashion. The paper presser plate 15 is swingably supported at its rear end part, thereby to be swingable between a placement position where the front end part of this paper presser plate lies below and extends along the bottom plate 16 of the paper feed tray 9, and a conveyance position where the front end part thereof lies above and inclines.

A lever 17 for lifting up the front end part of the paper presser plate 15 is disposed at the front end part of the paper feed tray 9. The lever 17 is formed substantially in the shape of letter L as viewed in section, so as to turn under the paper presser plate 15 from the front side of this paper presser plate. The upper end part of the lever 17 is mounted on a lever shaft 18 which is disposed at the front end part of the paper feed tray 9, while the rear end part thereof abuts on the lower surface of the front end part of the paper presser plate 15. Thus, when a turning drive force which is clockwise as viewed in FIG. 1 is input to the lever shaft 18, the lever 17 turns with a fulcrum at the lever shaft 18, and the rear end part of the lever 17 lifts up the front end part of the paper presser plate 15, so as to locate this paper presser plate 15 at the conveyance position. Incidentally, reference sign 15' indicates a state where the paper presser plate has been lifted up.

When the paper presser plate 15 is located at the conveyance position, the sheets of paper 3 on the paper presser plate 15 are pressed against the pickup roller 12 and begin to be conveyed toward the interspace between the feed roller 10 and the separation pad 11 by the rotation of the pickup roller 12.

On the other hand, when the paper feed tray 9 is dismounted from the body casing 2, the paper presser plate 15 has its front end part moved downwards by its own weight, and it is located at the placement position. When the paper presser plate 15 is located at the placement position, the sheets of paper 3 can be placed on the paper presser plate 15 in the stacked fashion.

The sheets of paper 3 delivered toward the interspace between the feed roller 10 and the separation pad 11 by the pickup roller 12 are reliably separated one by one and then fed when they are interposed between the feed roller 10 and the separation pad 11 by the rotation of the feed roller 10. The fed sheet of paper 3 passes between the feed roller 10 and the pinch roller 13, and it has paper powder removed by the paper-powder removal roller 8, whereupon it is conveyed to the registration rollers 14.

The registration rollers 14 consists of a pair of rollers, and after registration, they convey the sheet of paper 3 to a transfer position which lies between the photosensitive member 29 and a transfer roller 32 as stated later, and at which a toner image (corresponding to a developer image) on the photosensitive member 29 is transferred onto the sheet of paper 3. The photosensitive member 29 serves as "an image carrier".

The image formation section 5 includes a scanner portion 19, the process cartridge 20, and a fixation portion 21.

The scanner portion 19 is disposed at an upper part within the body casing 2, and the scanner portion 19 includes a laser light source which is not shown, a polygonal mirror 22 which is driven to rotate, an fθ lens 23, a reflector 24, a lens 25, and a reflector 26. A laser beam which is emitted from the laser light source and which is based on image data, is deflected by the polygonal mirror 22 and is passed through the fθ lens 23 as indicated by a chain line. Thereafter, the optical path of the laser beam is turned by the reflector 24 and is passed through the lens 25. Further, the optical path is crooked downwards by the reflector 26. Thus, the laser beam is projected onto the surface of the drum body 34 or the photosensitive member 29 of the process cartridge 20 as stated later.

The process cartridge 20 is detachably attached to the body casing 2 under the scanner portion 19. The process cartridge 20 includes as a housing, an upper frame 27, and a lower frame 28 which is formed as a member separate from the upper frame 27 and which is combined with the upper frame 27. The process cartridge 20 includes within the housing, the photosensitive member 29, a scorotron charger 30 (hereinbelow, also simply termed "charger 30") being a charging unit, the development cartridge 31, the transfer roller 32, and a cleaning brush 33.

The photosensitive member 29 includes the drum body 34 which is in the shape of a cylinder and whose outermost surface layer is formed of a positively-charged photosensitive layer made of polycarbonate, etc., and a metal-made drum shaft 35 which extends in the lengthwise direction of the drum body 34 along the axis of this drum body 34. As shown in FIGS. 2 through 4, the drum shaft 35 is supported by the upper frame 27, and the drum body 34 is supported so as to be rotatable relative to the drum shaft 35, whereby the photosensitive member 29 is disposed so as to be rotatable about the drum shaft 35 in the upper frame 27.

As shown in FIG. 1, the scorotron charger 30 is supported by the upper frame 27, and it is arranged in opposition to the photosensitive member 29 with a predetermined spacing so as not to touch this photosensitive member 29, obliquely above the rear side of this photosensitive member 29. The scorotron charger 30 includes a discharging wire 37, counter electrodes 38*a*, 38*a* which are arranged in opposition to each other and with a predetermined spacing in the axial direction of the photosensitive member 29, and a grid electrode 38*b* which is disposed between the discharging wire 37 and the photosensitive member 29 and which controls the quantity of electric discharge from the discharging wire 37 to the photosensitive member 29. In the scorotron charger 30, a bias voltage is applied to the counter electrodes 38*a*, 38*a* and the grid electrode 38*b*, while at the same time, a high voltage is applied to the discharging wire 37, and the discharging wire 37 is caused to generate corona discharge, whereby the surface of the photosensitive member 29 is uniformly charged to the positive polarity.

In the scorotron charger 30, a wiper 36 for cleaning the discharging wire 37 is disposed in a manner to embrace the discharging wire 37.

As shown in FIGS. 1 and 4, the development cartridge 31 is formed in the shape of a box whose rear side is open, and it is detachably attached to the lower frame 28. As shown in FIG. 1, a toner accommodation chamber 39, a supply roller 40, a development roller 41 and a layer-thickness regulation blade 42 are disposed in the development cartridge 31.

The toner accommodation chamber 39 is formed as the front internal space of the development cartridge 31 which is partitioned by a partition plate 43. In the toner accommodation chamber 39, a nonmagnetic single-component toner of positively-charging property is packed as a developing agent. Used as the toner is a polymerized toner which is obtained in such a way that polymerizable monomers, for example, a styrenic monomer such as styrene and an acrylic monomer such as acrylic acid, alkyl (C1-C4) acrylate or alkyl (C1-C4) methacrylate are copolymerized by suspension polymerization or the like. Such a polymerized toner is substantially globular and exhibits a very good fluidity, and it can achieve image formation of high image quality.

Incidentally, a coloring agent such as carbon black, a wax, etc. are compounded in such a toner, and an additive such as silica is added in order to enhance the fluidity. The mean grain diameter of the toner is about 6-10 μm.

An agitator 44 is disposed within the toner accommodation chamber 39. The toner in the toner accommodation chamber 39 is stirred by the agitator 44 and is emitted toward the supply roller 40 from a port 45 communicating in the front and rear direction under the partition plate 43.

The supply roller 40 is arranged on the rear side of the port 45, and is rotatably supported by the development cartridge 31. This supply roller 40 is configured in such a way that a metal-made roller shaft is covered with a roller which is made of an electrically-conductive foamed material. The supply roller 40 is driven to rotate by the input of power from a motor not shown.

The development roller 41 is rotatably supported by the development cartridge 31 on the rear side of the supply roller 40, in a state where this development roller 41 touches the supply roller 40 so as to be compressed each other. The development roller 41 opposes to and touches the photosensitive member 29 in a state where the development cartridge 31 is attached to the lower frame 28. The development roller 41 is configured in such a way that a metal-made roller shaft 96 (not shown in FIG. 1, refer to FIG. 4) is covered with a roller which is made of an electrically-conductive rubber material. As shown in FIG. 4, the roller shaft 96 has both its end parts protruded from the side surfaces of the development cartridge 31 outwards in a widthwise direction orthogonal to the front and rear direction, at the rear end part of this development cartridge 31. The constituent roller of the development roller 41 is such that the surface of a roller body which is made of electrically-conductive urethane rubber or silicone rubber containing carbon particles or the likes is covered with a coat layer of fluorinated urethane rubber or silicone rubber. A development bias is applied to the development roller 41 during development. The development roller 41 is driven to rotate in the same direction as that of the supply roller 40 by the input of power from a motor not shown.

As shown in FIG. 1, the layer-thickness regulation blade 42 includes a blade body 46 which is made of a metallic leaf spring member, and it is provided at its distal end part of the blade body 46 with a pressing portion 47 of semicircular section which is made of insulating silicone rubber. The layer-thickness regulation blade 42 is supported by the development cartridge 31 above the development roller 41, and has the pressing portion 47 brought into pressed touch onto the development roller 41 by the elastic force of the blade body 46.

The toner emitted from the port 45 is supplied onto the development roller 41 by the rotation of the supply roller 40. On this occasion, the toner is frictionally charged into the positive polarity between the supply roller 40 and the development roller 41. The toner supplied onto the development roller 41 advances into the interspace between the development roller 41 and the pressing portion 47 of the layer-thickness regulation blade 42 with the rotation of the development roller 41, and it is further charged here, so as to be carried on the development roller 41 as a thin layer of predetermined thickness.

The transfer roller 32 serves as "transfer member", and is configured so as to transfer the toner image carried on the photosensitive member 29, onto the sheet of paper 3. The transfer roller 32 is rotatably supported by the lower frame 28, and it is arranged so as to oppose to and touch the photosensitive member 29 in the up and down direction and to form a nip between it and the photosensitive member 29, in the state where the upper frame 27 and the lower frame 28 are combined. Here, the transfer roller 32 is configured in such a way that a metal-made shaft member 32*a* is covered with a roller 32*b* made of an electrically-conductive rubber material. A transfer bias of negative polarity is applied to the transfer roller 32 during transfer. Besides, the transfer roller 32 is driven to rotate in the direction opposite to that of the photosensitive member 29 by the input of power from a motor not shown. Incidentally, a bias which is opposite in polarity to the bias applied to the charger 30 is applied as the transfer bias.

The cleaning brush 33 is mounted on the lower frame 28, and it is arranged so as to oppose to and touch the photosensitive member 29 on the rear side of this photosensitive member 29, in the state where the upper frame 27 and the lower frame 28 are combined.

The surface of the photosensitive member 29 is positively charged uniformly by the scorotron charger 30 by the rotation of this photosensitive member 29, and it is thereafter exposed to light by the high-speed scanning with the laser beam from the scanner portion 19, thereby to be formed with an electrostatic latent image corresponding to the image which is to be formed on the sheet of paper 3.

Subsequently, when the toner which is carried on the development roller 41 and which is positively charged is brought into opposition to and touch with the photosensitive member 29 by the rotation of the development roller 41, it is supplied to the electrostatic latent image which is formed on the surface of the photosensitive member 29, that is, the exposed part which has been exposed to the light by the laser beam and whose electric potential is lower, in the surface of the photosensitive member 29 positively charged uniformly. Thus, the electrostatic latent image of the photosensitive member 29 is visualized, and the toner image based on reversal development is carried on the surface of the photosensitive member 29.

Thereafter, the toner image carried on the surface of the photosensitive member 29 is transferred onto the sheet of paper 3 by the transfer bias applied to the transfer roller 32, while as shown in FIG. 1, the sheet of paper 3 being conveyed by the registration rollers 14 passes through the transfer position P1 between the photosensitive member 29 and the transfer roller 32. The sheet of paper 3 on which the toner image has been transferred, is conveyed to the fixation portion 21.

Incidentally, residual toner which remains on the photosensitive member 29 after the transfer is recovered by the development roller 41. Paper powder from the sheet of paper 3 as is adherent on the photosensitive member 29 after the transfer is recovered by the cleaning brush 33.

The fixation portion 21 serves as "fixation member", and fixes the toner image (developer image) transferred by the transfer roller 32, onto the sheet of paper (recording medium) 3. The fixation portion 21 is disposed on the rear side of the process cartridge 20, and it includes a fixation frame 48, and a heating roller 49 and a pressing roller 50 which are disposed within the fixation frame 48.

The heating roller 49 includes a metal pipe whose surface is coated with a fluorine resin, and a heating halogen lamp disposed in the metal pipe. The heating roller 49 is driven to rotate by the input of power from a motor not shown.

The pressing roller 50 is arranged under the heating roller 49 and in opposition thereto so as to press this heating roller 49. This pressing roller 50 is configured by covering a metal-made roller shaft with a roller made of a rubber material, and it is driven in accordance with the rotating drive of the heating roller 49.

In the fixation portion 21, the toner transferred onto the sheet of paper 3 at the transfer position P1 is thermally fixed while this sheet of paper 3 passes between the heating roller 49 and the pressing roller 50. The sheet of paper 3 on which the toner has been fixed, is conveyed to a paper-ejection path 51 which extends in the up and down direction toward the upper surface of the body casing 2. The sheet of paper 3 conveyed to the paper-ejection path 51 is ejected onto a paper-ejection tray 53 formed on the upper surface of the body casing 2, by paper-ejection rollers 52 disposed on the upper side of the paper-ejection path 51.

As shown in FIG. 2, the upper frame 27 disposed in the process cartridge 20 includes a left sidewall 54, a right sidewall 55 and an upper wall 56 integrally.

As shown in FIGS. 2 and 3, the left sidewall 54 includes a left lower plate portion 57 which opposes to the drum body 34 from one side in the widthwise direction (the axial direction of the photosensitive member 29) (hereinbelow, one side in the widthwise direction shall be termed the "left side", and the other side in the widthwise direction the "right side"), an extension plate portion 58 which extends from the upper end edge of the left lower plate portion 57 toward the right side, and a left upper plate portion 59 which extends upwards from the right end edge of the extension plate portion 58.

A bearing member 66 that supports the drum shaft 35 is fitted into the left lower plate portion 57, and the drum shaft 35 is inserted through a hole, not shown, which is formed in the bearing member 66.

As shown in FIG. 3, the left upper plate portion 59 is provided on its front side with a first terminal 61 for electric is supply to the discharging wire 37 of the scorotron charger 30, and it is provided on its rear side with a second terminal 62 for electric supply to the counter electrodes 38*a*, 38*a* and grid electrode 38*b* of the scorotron charger 30. The upper end edge of the left upper plate portion 59 is formed by a horizontal part which extends substantially horizontally in the front and rear direction, and an inclined part which extends obliquely downwards from the rear end of the horizontal part.

As shown in FIG. 2, the right sidewall 55 is formed in the shape of a flat plate, and it opposes to the drum body 34 from the right side. The upper end edge of the right sidewall 55 is formed in correspondence with the upper end edge of the left upper plate portion 59, by a horizontal part which extends substantially horizontally in the front and rear direction and which opposes to the horizontal part of the upper end edge of the left upper plate portion 59, and an inclined part which extends obliquely downwards from the rear end of the horizontal part and which opposes to the inclined part of the upper end edge of the left upper plate portion 59. Besides, a bearing member 67 is fitted into the right sidewall 55, and the drum shaft 35 is inserted through a hole, not shown, which is formed in the bearing member 67.

As stated above, the drum shaft 35 of the photosensitive member 29 is supported through the bearing members 66 and 67 which are respectively arranged at the left and right. Both the end parts of the drum shaft 35 protrude from the respective bearing members 66 and 67 outwards in the left and right directions, and stopper members 78 are respectively fitted outside both the end parts. Thus, the drum shaft 35 is prevented from coming off, by the stopper members 78. Connected to the end part of the drum shaft 35 protruding from the left bearing member 66 is earth member, not shown, which is disposed on the body casing 2 in order to ground the drum shaft 35 in the state where the process cartridge 20 is attached to the body casing 2.

The drum shaft 35 supports the drum body 34 so as to be relatively rotatable, between the bearing members 66 and 67. A gear member (not shown) is mounted on the left end part of the drum body 34 in the axial direction thereof, and power is transmitted from a main motor, not shown, to the gear member, whereby the drum body 34 (refer to FIG. 1) is rotated.

The upper wall 56 includes an upper horizontal portion 64 and an upper inclined portion 65 as shown in FIG. 2. The upper horizontal portion 64 is spanned between the horizontal part of the upper end edge of the left upper plate portion 59 and the horizontal part of the upper end edge of the right sidewall 55.

The upper horizontal portion 64 is arranged over the photosensitive member 29. Besides, the upper horizontal portion 64 is provided with a laser entrance window 164 for entering the high-speed-scanning laser beam LB (refer to FIG. 1) from the scanner portion 19, substantially in a rectangular shape as is viewed in plan. Further, a plurality of air passages 162 to be stated later are provided in adjacency to the laser entrance window 164.

The upper inclined portion 65 is spanned between the inclined part of the upper end edge of the left upper plate portion 59 and the inclined part of the upper end edge of the right sidewall 55. This upper inclined portion 65 is arranged obliquely above the rear side of the photosensitive member 29 with a predetermined spacing from the upper horizontal portion 64 in the front and rear direction. The scorotron charger 30 stated before is disposed on the upper inclined portion 65. The discharging wire 37 is extended between the left upper plate portion 59 and the right sidewall 55 in the upper inclined portion 65, and the counter electrodes 38*a*, 38*a* and the grid electrode 38*b* are spanned between the left upper plate portion 59 and the right sidewall 55 in the upper inclined portion 65.

The lower frame 28 is provided with a pair of sidewalls 92 as shown in FIG. 2, and the left sidewall 92 is formed with an opening 111 for exposing a transfer electrode 113, as shown in FIG. 3. The left sidewall 92 is provided with a cleaning electrode 104 for applying a cleaning bias to the cleaning brush 33 (FIG. 1).

Next, the configuration of the conveyance path will be described.

Figure 5:
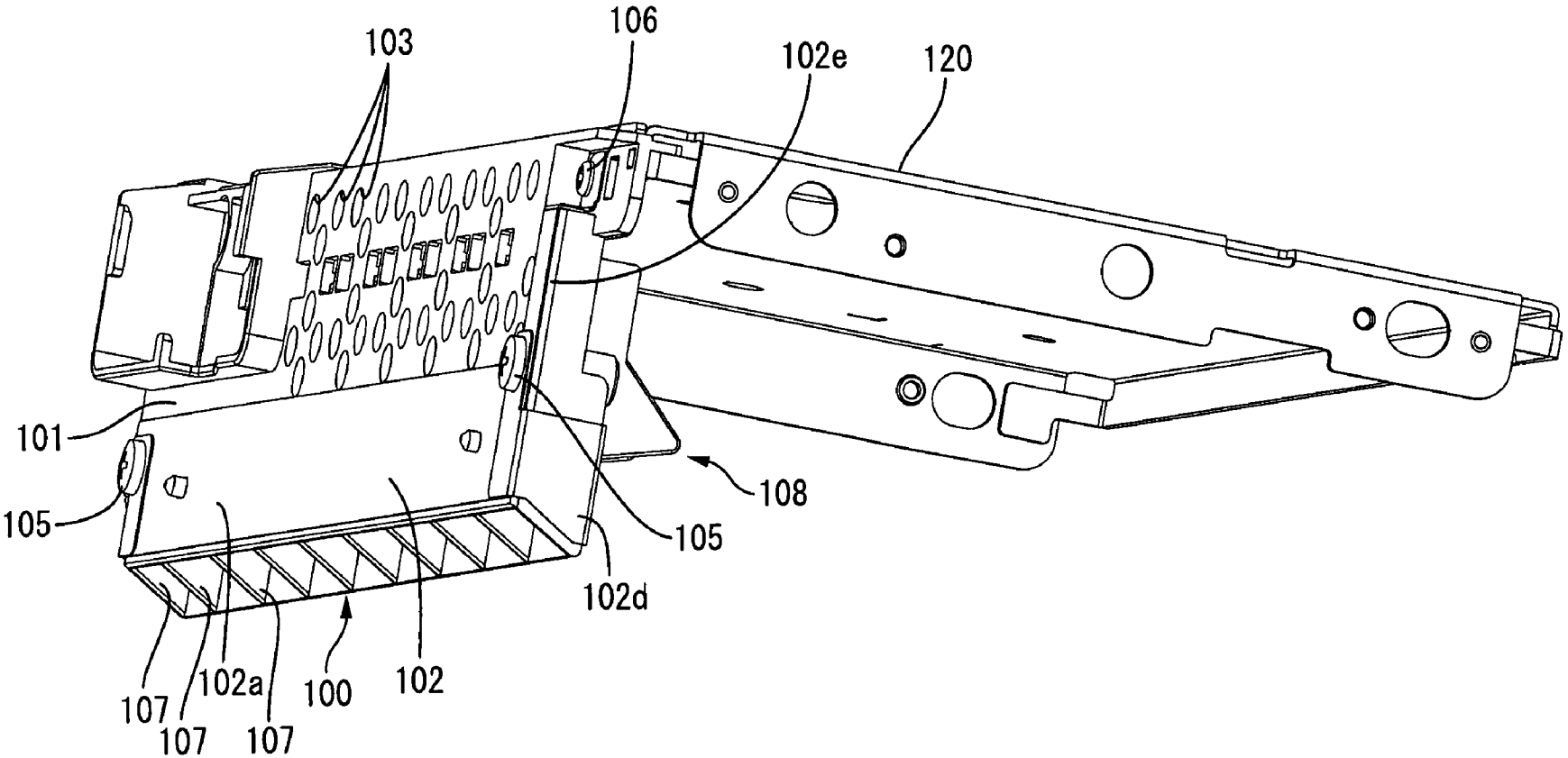
FIG. 5 is a perspective view showing a configuration in the vicinity of a duct portion.
Figure 6:
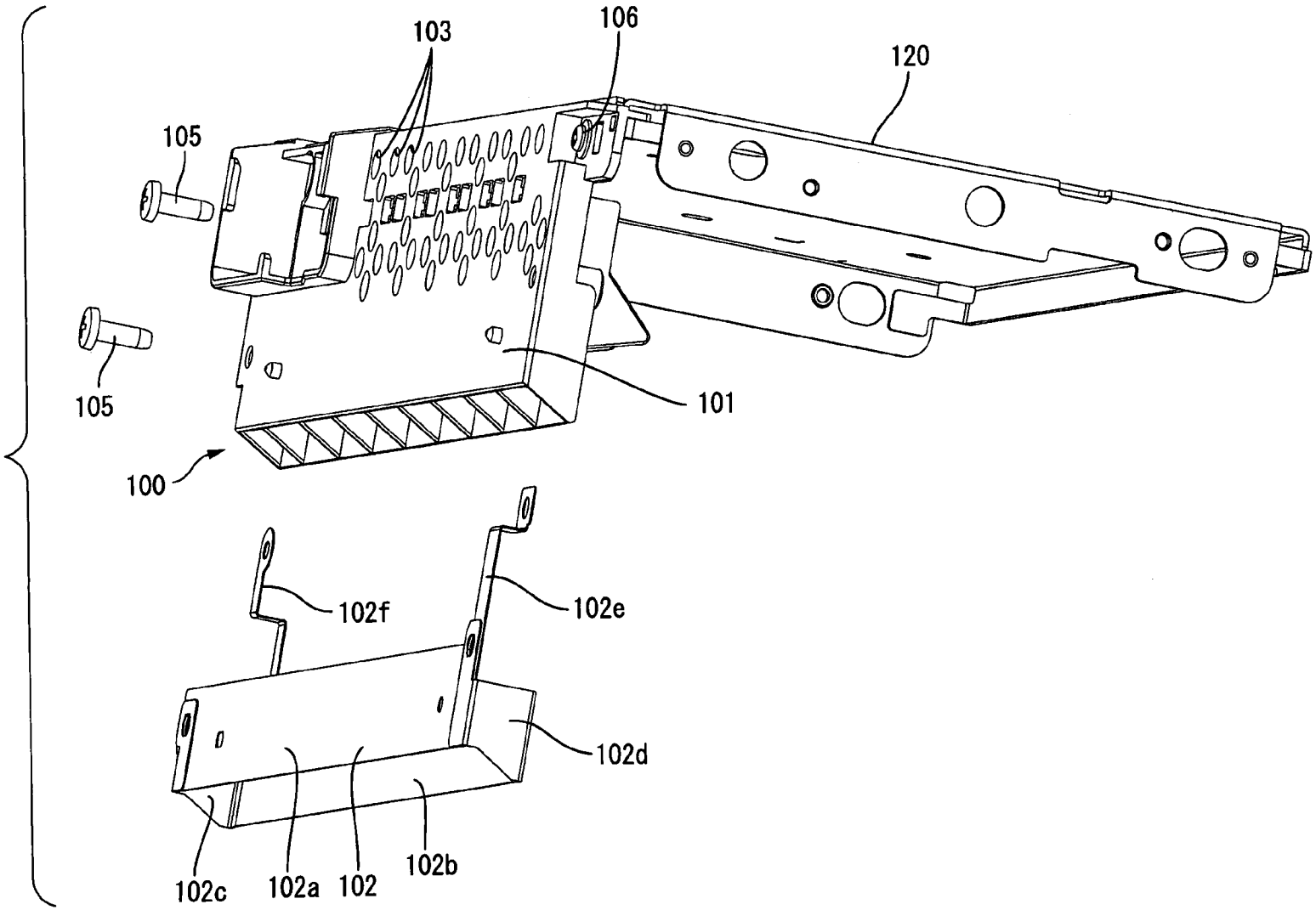
FIG. 6 is a perspective view showing a state where a first electrically-conductive member has been detached from the duct portion.
Figure 7:
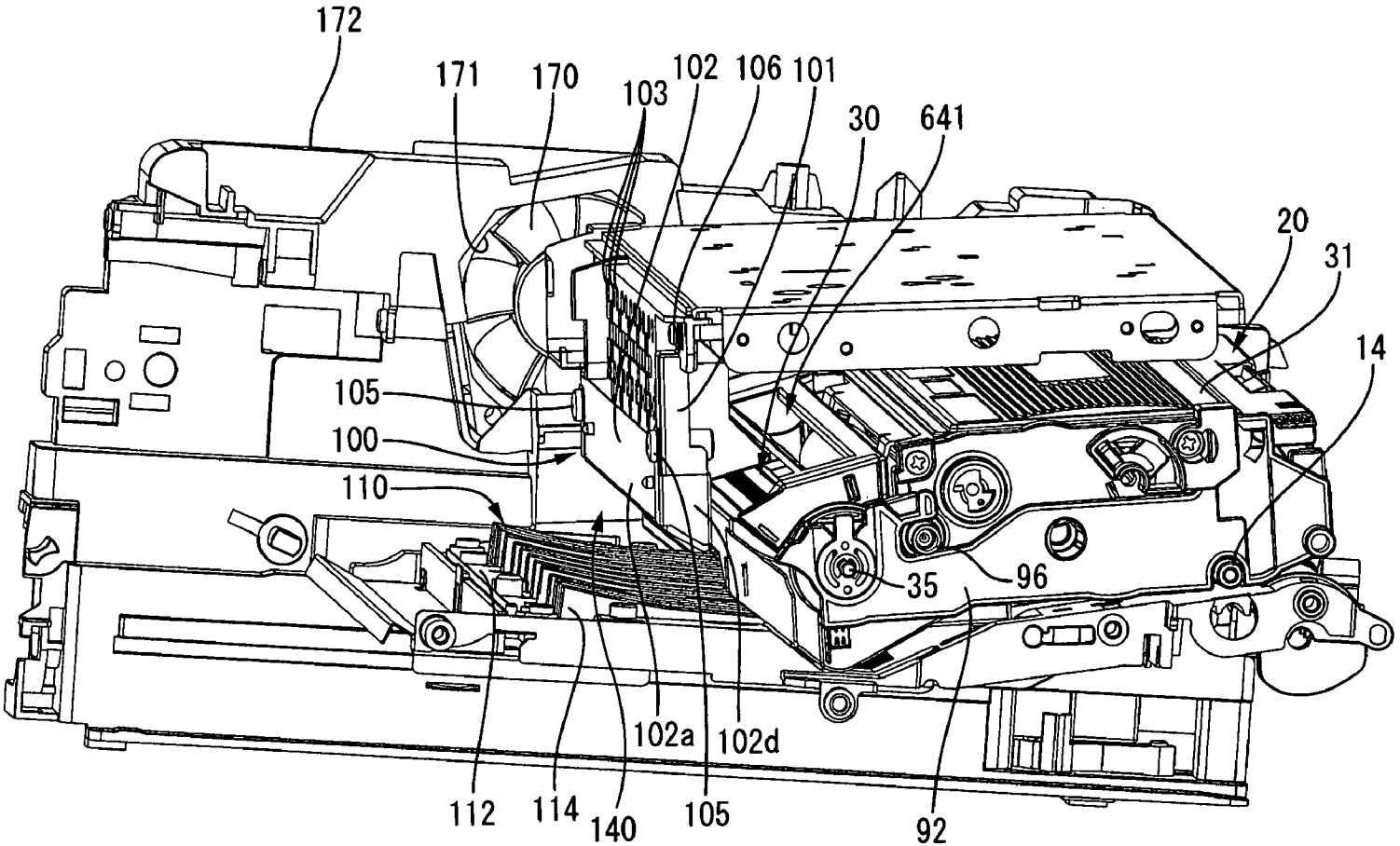
FIG. 7 is a perspective view showing the arrangement of the process cartridge, the duct, the guide member and one frame of an apparatus body in the laser printer.
Figure 8:
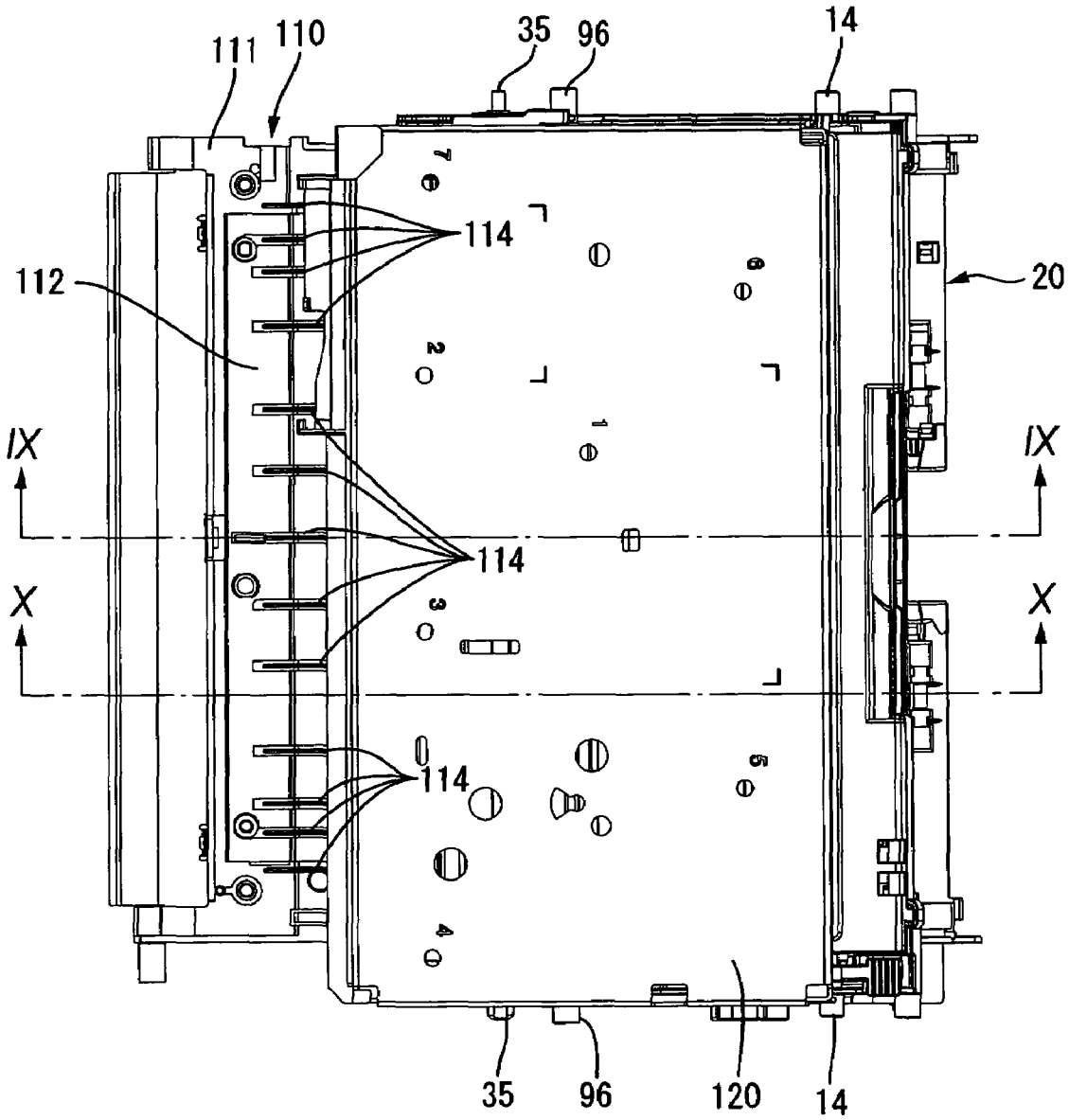
FIG. 8 is a plan view showing the arrangement of the process cartridge, the duct and the guide member.
Figure 9:
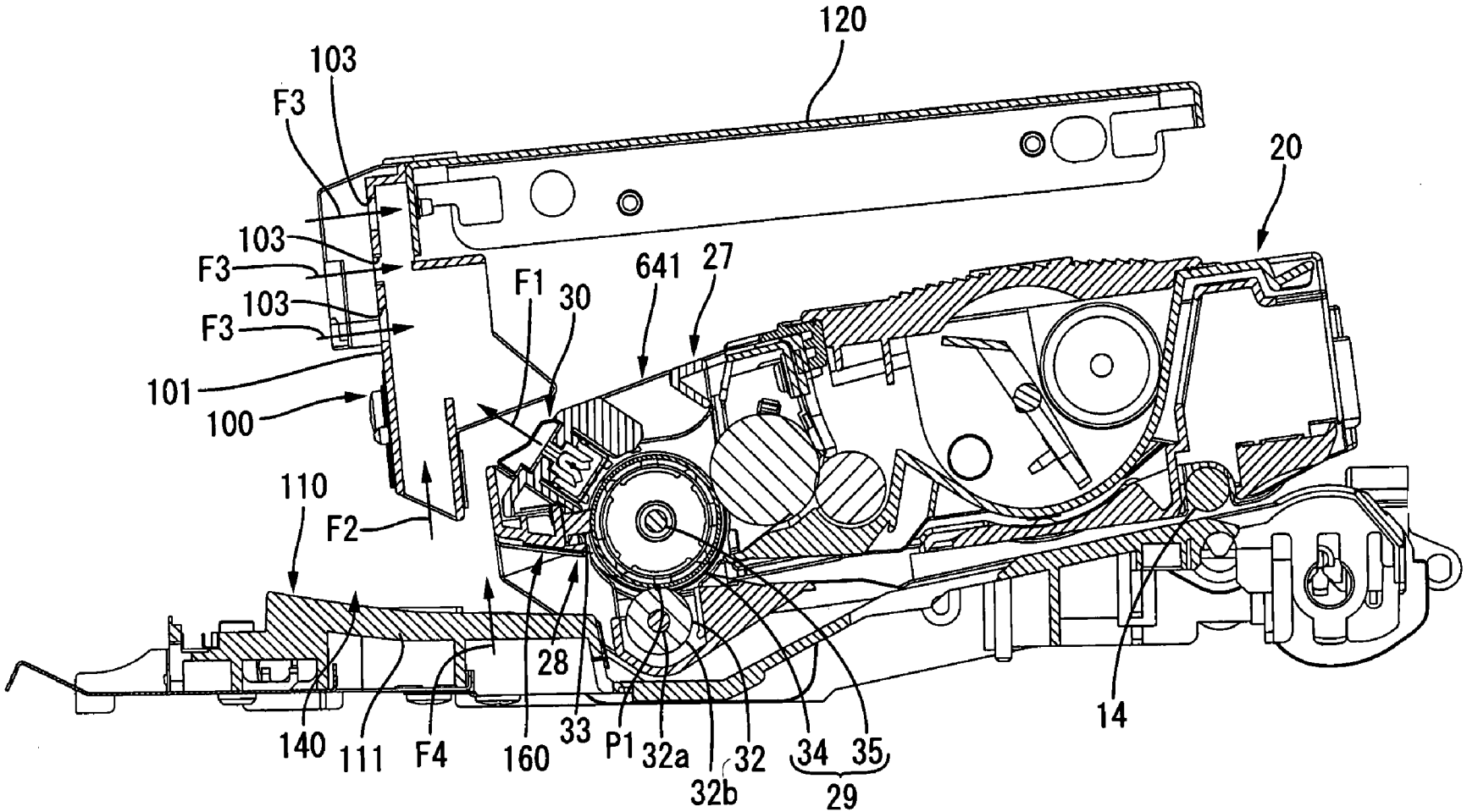
FIG. 9 is a sectional view showing sectional plane IX-IX shown in FIG. 8.
Figure 10:
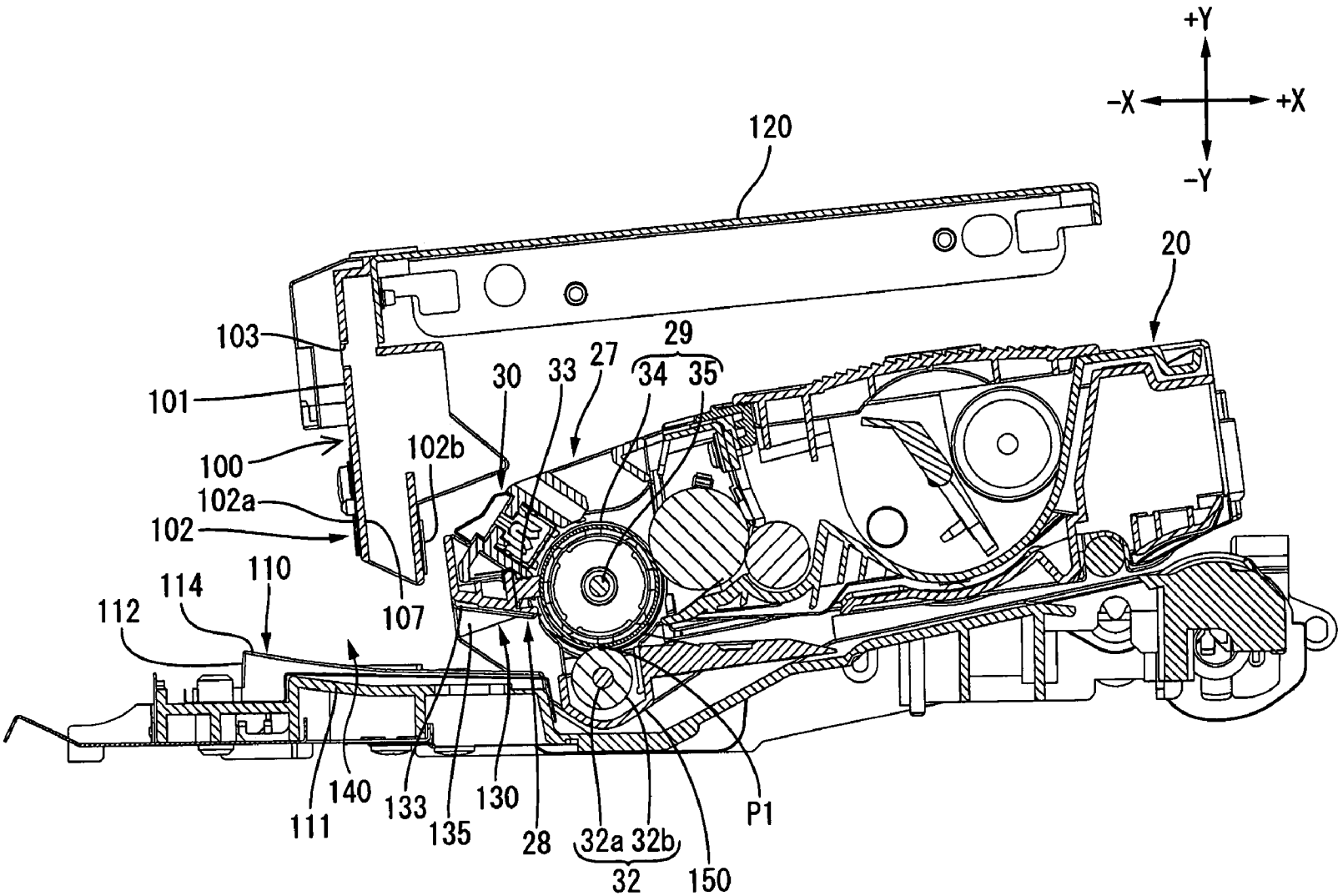
FIG. 10 is a sectional view showing sectional plane X-X shown in FIG. 8.

First, a member on the side of the image forming surface of the sheet of paper 3 will be described. FIG. 5 shows the perspective view of a duct portion 100 which corresponds to the member on the image forming surface side, and FIG. 6 shows a state where a first electrically-conductive member has been detached from a duct body 101. FIG. 7 is a perspective view showing the arrangement of the process cartridge, the duct, the guide member and one frame of the apparatus body in the laser printer, and FIG. 8 is a plan view showing the arrangement of the process cartridge, the duct and the guide member. FIG. 9 is a sectional view showing section IX-IX (center section) shown in FIG. 8, and FIG. 10 is a sectional view showing section X-X shown in FIG. 8.

The laser printer 1 according to the first embodiment is configured so as to form an image on the sheet of paper while this sheet of paper is being conveyed between the transfer roller 32 and the fixation portion 21 shown in FIG. 1. In the sheet of paper 3 which is conveyed between the transfer roller 32 and the fixation portion 21 (hereinbelow, the sheet of paper which lies in a conveyance state between the transfer roller 32 and the fixation portion 21 shall be termed the "conveyance sheet of paper 3'"), the surface on the side of the photosensitive member 29 corresponds to the image forming surface, the duct portion 100 is arranged on the image forming surface side of the conveyance sheet of paper 3' in opposition to the image forming surface. The duct portion 100 corresponds to the "first member", and is disposed so as to confront the image forming surface of the conveyance sheet of paper 3'.

On the other hand, the guide member 110 which corresponds to a member on a non-image-forming surface side is arranged between the transfer roller 32 and the fixation portion 21 and on the side of the surface of the conveyance sheet of paper 3' opposite to the image forming surface thereof (that is, on the side of the non-image-forming surface of the conveyance sheet of paper 3'). Here, in the conveyance sheet of paper 3', the surface on the side of the transfer roller 32 corresponds to the opposite surface (the non-image-forming surface). The guide member 110 is arranged in opposition so as to confront the non-image-forming surface of the conveyance sheet of paper 3'. The duct portion 100 and the guide member 110 are configured so as to oppose to each other, and in forming the image, the sheet of paper 3 pass between the duct portion 100 and the guide member 110.

As shown in FIG. 5, the duct portion 100 includes the first electrically-conductive member 102 which is made of a flat metal member (for example, a zinc-coated member prepared by zincking a stainless steel plate or an iron plate), and which exhibits an electric conductivity. The first electrically-conductive member 102 is disposed so as to cover the outer surface of the duct body 101 made of a non-electrically-conductive material (here, a resin material) in the duct portion 100, and it is grounded. Concretely, the first electrically-conductive member 102 is connected with an electrically-conductive frame 120 disposed for the scanner portion 19, by screw members 106 as shown in FIGS. 5 and 6, and both the first electrically-conductive member 102 and the frame 120 are connected to the earth member, not shown, in the laser printer 1. The frame 120 overlies the process cartridge 20 as shown in FIGS. 7 and 8, and the scanner unit 19 (refer to FIG. 1) is arranged between the frame 120 and the process cartridge 20 so as to be mounted on this frame 120.

As shown in FIGS. 5 and 6, the first electrically-conductive member 102 is arranged so as to directly oppose to the image forming surface of the conveyance sheet of paper 3' (refer to FIG. 1) in the duct portion 100. Besides, the first electrically-conductive member 102 includes parts which cover the outer surface of the duct portion 100 being the member on the side of the image forming surface, that is, a flat coverage portion 102*a* which covers one wall surface of the duct body 101, and a flat coverage portion 102*b* which covers the other wall surface. Further, the first electrically-conductive member 102 includes coverage portions 102*c* and 102*d* which cover sidewalls. These coverage portions 102*a*, 102*b*, 102*c* and 102*d* are arranged so as to annularly cover the wall surfaces of the duct body 101 around this duct body 101. Besides, the first electrically-conductive member 102 is mounted on the duct body 101 by screw members 105. Extension portions 102*e* and 102*f* are respectively extended from the coverage portions 102*a* and 102*b* onto a side opposite to the side of the conveyance sheet of paper 3' (FIG. 1), and these extension portions 102*e* and 102*f* are connected with the frame 120 by the screw members 106 in the vicinity of the upper end part of the duct portion 101.

In the configuration of the first embodiment, the first electrically-conductive member 102 which exhibits the electric conductivity and which is grounded is disposed in the duct portion 100 which is interposed between the transfer roller 32 and the fixation portion 21, so that the potential of the entirety of the first electrically-conductive member 102 and the duct portion 100 as combined approaches to zero. Therefore, even when the duct portion 100 is arranged nearer to the conveyance sheet of paper 3' (FIG. 1) due to the reduction of the size of the laser printer 1, the potential of the image forming surface side is controlled to be constant, and the behavior of the conveyance sheet of paper 3' can be stabilized. Particularly in the laser printer 1 of this embodiment, the charger 30 is arranged on the image forming surface side of the conveyance sheet of paper 3', while the transfer roller 32 is arranged on the non-image-forming surface side, and the bias which is opposite in polarity to the bias applied to the transfer roller 32 is applied to the charger 30, so that the conveyance sheet of paper 3' becomes liable to be attracted to the duct portion 100. In contrast, in the configuration according to this embodiment, the first electrically-conductive member 102 is grounded to zeroize its potential, whereby the potential difference between the conveyance sheet of paper 3' and the duct portion 100 including the first electrically-conductive member 102 is made small, so that the attraction of the conveyance sheet of paper 3' is effectively preventable. Besides, the duct portion 100 does not exert influence on the sheet of paper, so that the distance between the duct portion 100 and the conveyance sheet of paper 3' can be set small, and the reduction of the size of the whole apparatus (especially, the reduction of the size in the height direction) is realized.

As shown in FIG. 5, the duct portion 100 is provided with suction ports 103, 107 and 108, through which air in the interior of the laser printer 1 is drawn by suction so as to be exhausted to the exterior. Concretely, as shown in FIG. 7, a fan 170 and an exhaust port 171 communicating with the internal space of the duct portion 100 are provided in a frame 172 which forms one sidewall of the laser printer 1, and the internal air of the laser printer 1 is drawn through the suction ports 103, 107 and 108 by the suction based on the fan 170, so as to be exhausted out of the laser printer 1 through the interior of the duct portion 100.

As shown in FIG. 9, the duct portion 100 according to this embodiment is configured so that air within the charger 30 can is be drawn through the suction port 108 by suction, so as to be exhausted out of the apparatus through the exhaust port 171. Incidentally, with the configuration in which the air within the charger 30 is exhausted by the duct portion 100 in this manner, the interior of the charger 30 can be advantageously held clean, but there is disadvantageously posed the problem that the duct portion 100 becomes liable to be charged under the influence of the air from the charger 30. Since the bias opposite in polarity to the transfer bias is applied to the charger 30, the conveyance sheet of paper 3' (FIG. 1) charged in the same polarity as that of the transfer bias is attracted toward the duct portion 100. In the configuration of the first embodiment, however, the first electrically-conductive member 102 is disposed in the grounded state within such a duct portion 100, so that the interior of the charger 30 is held clean, and the attraction of the conveyance sheet of paper 3' to the duct portion 100 is effectively suppressed. In FIG. 9, the stream of the air from the charger 30 toward the duct portion 100 is indicated by an arrow F1.

As shown in FIG. 9, the duct portion 100 is configured so that, not only the air within the charger 30, but also the air of a space 140 on the side of the fixation portion 21 can be exhausted to the exterior. In FIG. 9, the streams of the air from the space 140 on the fixation portion side, toward the duct portion 100 are indicated by arrows F2 and F3. As shown in FIGS. 5 and 7, the large number of suction ports 103 (only three of which have the reference numeral assigned thereto in FIG. 5) are provided in that wall part of the duct body 101 of the duct portion 100 which lies on a downstream side in the conveyance direction of the sheet of paper, and the plurality of suction ports 107 (only three of which have the reference numeral assigned thereto in FIG. 5) are provided in that end part of the duct body 101 which lies on a side opposing to the conveyance sheet of paper 3' (FIG. 1). The air from the space 140 on the charger side flows into the duct portion 100 through the suction ports 103 and 107 as shown in FIG. 9, and it is exhausted from the exhaust port 171 shown in FIG. 7. Incidentally, although not shown in FIG. 9, a plurality of vent holes 142 (refer to FIG. 16) are provided in the guide member 110, and air outside the laser printer 1 enters the interior thereof through the vent holes 142. In FIG. 9, the stream of the air is indicated by an arrow F4.

Figure 11:
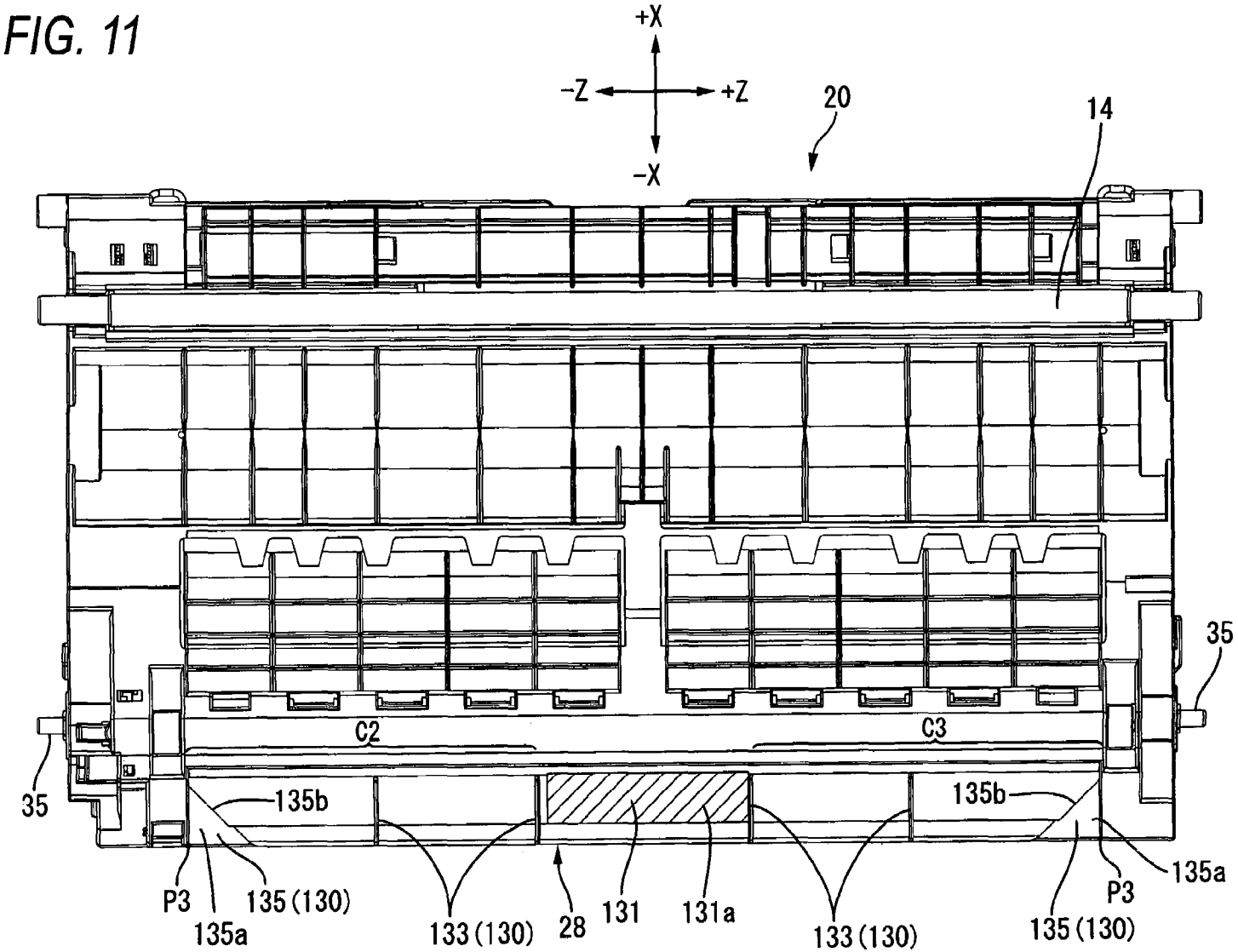
FIG. 11 is a view of the process cartridge as seen from the back surface side thereof.

FIG. 11 is the view of the process cartridge as seen from the back surface side thereof.

In the first embodiment, the housing (concretely, the lower frame 28) of the process cartridge 20 forms part of the member on the image forming surface side, together with the duct portion 100.

As shown in FIGS. 10 and 11, that lower frame 28 of the housing of the process cartridge 20 which forms part of the member on the image forming surface side is provided with an attraction suppression portion 130 at a position which lies downstream of the transfer position P1 based on the transfer roller 32, in the paper conveyance direction. The attraction suppression portion 130 is configured so that the rear end part of the sheet of paper having passed through the transfer position P1 may be restrained from being attracted onto the side of the process cartridge 20, by the abutment of the portion 130 on the rear end part. More specifically, when the sheet of paper has passed through the transfer position P1, the rear end part thereof is released from the support of the photosensitive member 29, and the image forming surface side thereof becomes free from restraint. In this state, the rear end part of the sheet of paper is apprehended to be attracted to that part of the housing (specifically, the lower frame 28) of the process cartridge 20 which lies on the image forming surface side (that is, to the end part of the process cartridge 20). In the configuration shown in FIGS. 10 and 11, however, the attraction suppression portion 130 is disposed at the fixation-portion side end part of the lower frame 28 in the process cartridge 20, so that even after the sheet of paper has passed through the transfer position P1, the rear end part of the sheet of paper is less liable to be attracted to the end part of the lower frame 28, owing to the abutment of the attraction suppression portion 130, and the behavior of the sheet of paper is stabilized still more.

Figure 12A:
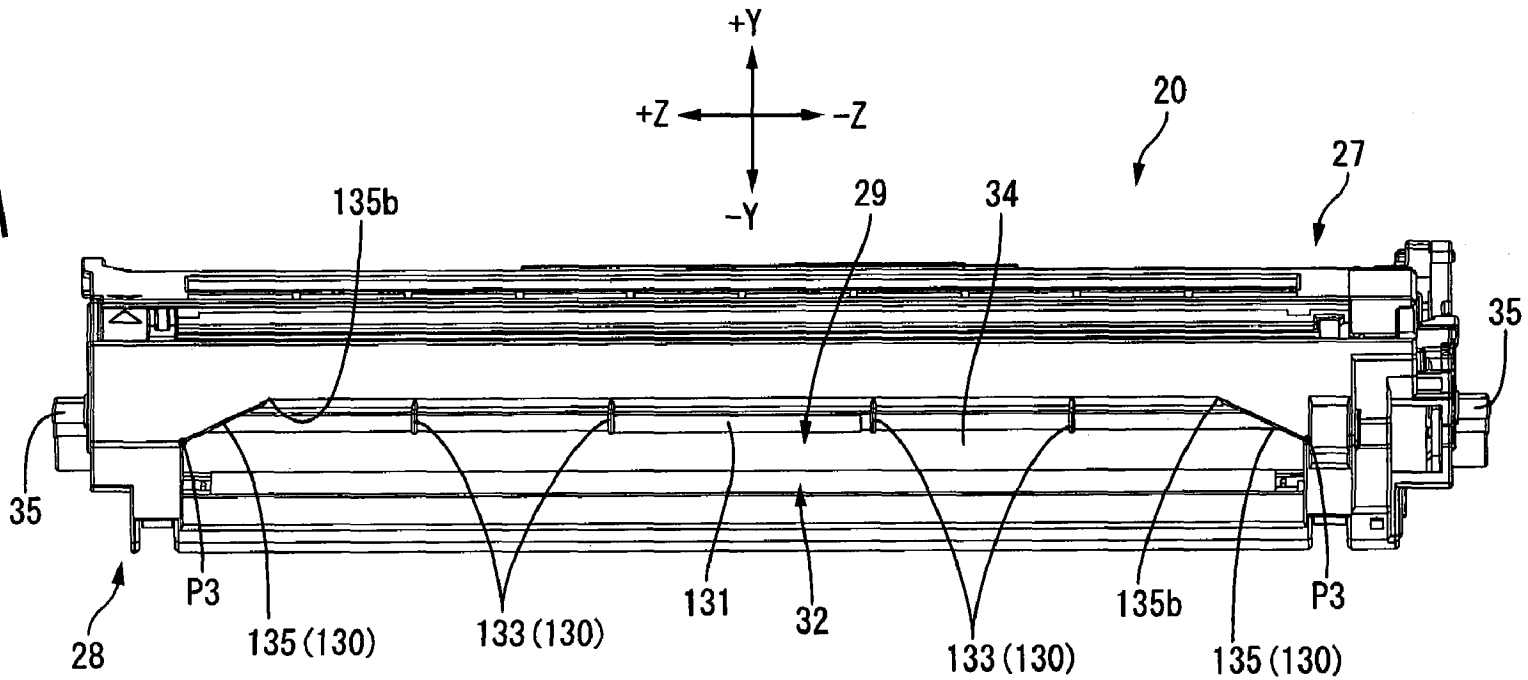
Figure 12B:
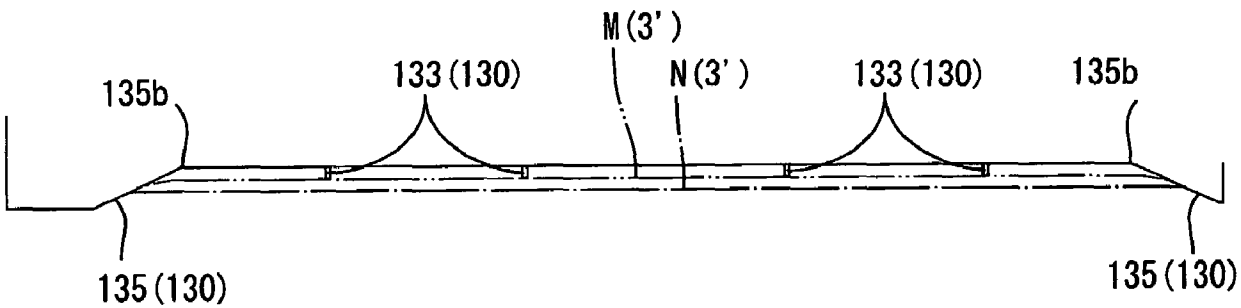
FIG. 12B is an explanatory diagram for conceptually explaining the behavior of the rear end part of a conveyance sheet of paper at the end part of the process cartridge.

FIG. 12A shows the view of the process cartridge 20 as seen from the side of the fixation portion, while FIG. 12B conceptually illustrates the behavior of the rear end part of the conveyance sheet of paper 3' at the end part of the process cartridge 20. Incidentally, the conveyance sheet of paper 3' exemplified in FIG. 12B is a sheet of paper of maximum size for use in the laser printer 1. As shown in FIG. 11 and FIGS. 12A and 12B, the attraction suppression portion 130 is configured of first protrusive portions 135 which protrude in directions opposing to the sheet of paper, at positions opposing to both the end parts of the conveyance sheet of paper 3' (refer to FIGS. 1 and 12B) in the widthwise direction thereof (that is, in the Z-axial direction), and rib-like second protrusive portions 133 which are disposed so as to extend in the paper conveyance direction, at positions nearer to the middle of the conveyance sheet of paper 3' than the positions of the first protrusive portions 135 in the widthwise direction (Z-axial direction) of this conveyance sheet of paper 3'.

In the configuration, as shown in FIG. 12B, both the widthwise end portions of the conveyance sheet of paper 3' are supported by the first protrusive portions 135, and the support by the first protrusive portions 135 is difficult to influence that widthwise middle part of the conveyance sheet of paper 3' on which the image is formed. The rib-like second protrusive portions 133 extending in the paper conveyance direction are disposed in addition to the first protrusive portions 135, and the prevention of the attraction of the rear end part of the sheet of paper is attained also at the middle side parts without considerably influencing the image formation. In FIG. 12B, the behavior of the rear end part of the conveyance sheet of paper 3' in an ordinary mode is conceptually illustrated by a dot-and-dash line N, while the behavior of the rear end part of the conveyance sheet of paper 3' in the case where a very strong attraction has occurred (that is, in the worst case) is indicated by a two-dot chain line M. As seen from the figure, in the case of using the sheet of paper of the maximum size, the second protrusive portions 133 support the conveyance sheet of paper 3' only in the case where the very strong attraction has occurred.

As shown in FIG. 12A, the first protrusive portions 135 protrude in such a manner that their protrusion amounts gradually become smaller from both the end sides of the sheet of paper in the widthwise direction thereof (in the Z-axial direction), toward the middle side of this sheet of paper. In this manner, the first protrusive portions 135 are constructed having the protrusion amounts which gradually become smaller from both the end sides toward the middle side, so that even in the case where the attraction of the conveyance sheet of paper 3' has occurred as in FIG. 12B, the influence on the part of the widthwise middle side on which the image is formed in the conveyance sheet of paper 3' is relieved still further, and an image formation quality is enhanced still more.

As shown in FIG. 11, the first protrusive portions 135 include slant surfaces 135*a* each of which is constructed so as to confront the conveyance sheet of paper 3' (FIGS. 1 and 12B) and to incline relative to the image forming surface of the sheet of paper. Each of the slant surfaces 135*a* is formed substantially in the shape of a triangle as viewed from the rear surface side thereof. In more detail, as shown in FIG. 11 and FIGS. 12A and 12B, the triangular shape has a small protrusion amount on the side of an end part 135*b*, and a large protrusion amount on the side of an end part P3. Thus, the slant surfaces 135*a* gradually come nearer to the conveyance sheet of paper 3' toward the downstream side in the conveyance direction and both the end sides in the widthwise direction. In this manner, in the first protrusive portions 135 disposed at both the widthwise end portions, the slant surfaces 135*a* are constructed so as to gradually come nearer to the conveyance sheet of paper 3' toward the downstream side in the conveyance direction and both the end sides in the widthwise direction (Z-axial direction), so that while both the end parts of the conveyance sheet of paper 3' are supportable, the protrusion of the first protrusive portions 135 is less liable to hamper the conveyance of the sheet of paper.

Figure 13:
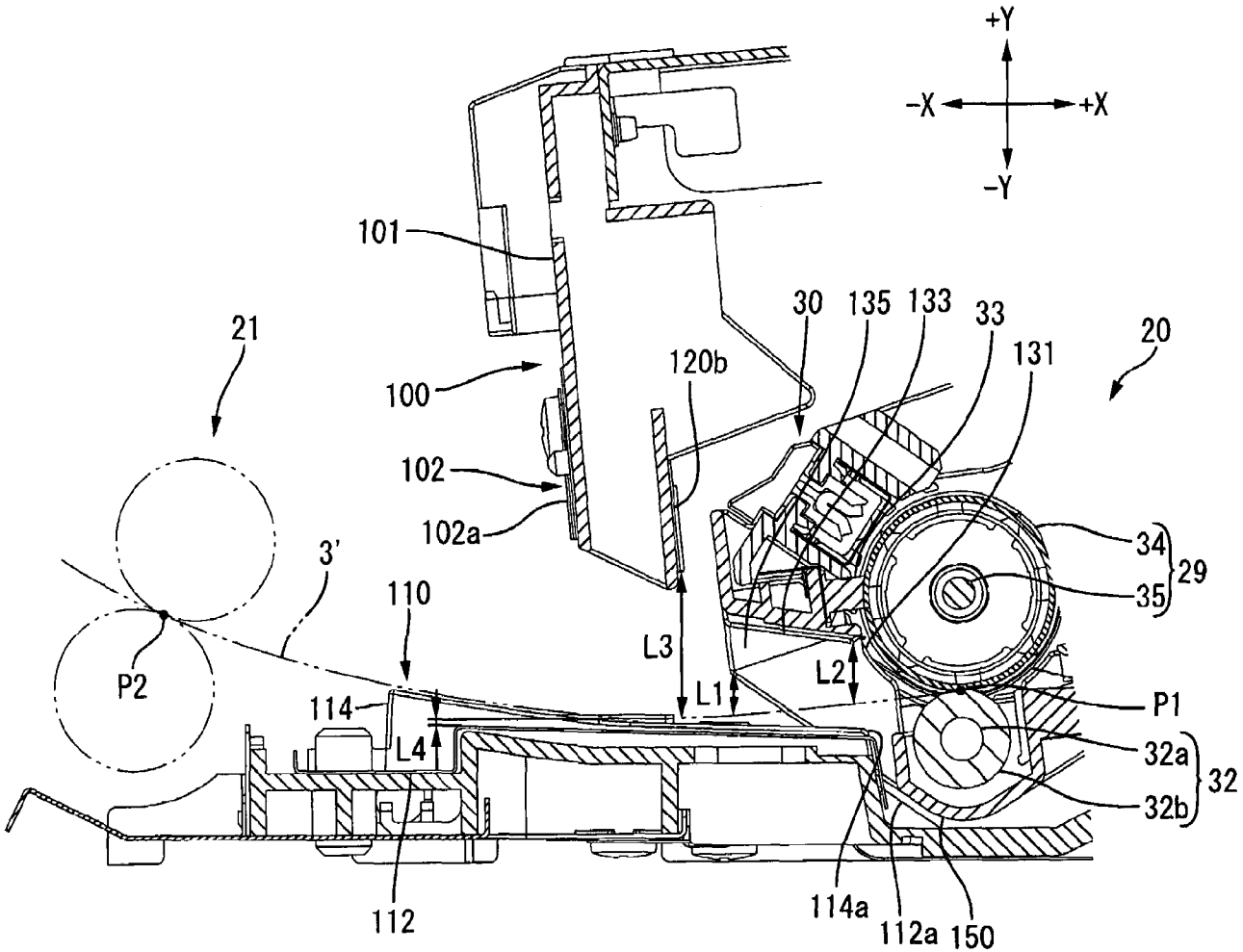
FIG. 13 is an explanatory view for explaining the positional relationship of various members by using an enlarged view in which part of FIG. 10 is enlarged.

As shown in FIG. 13, the distance L2 between each second protrusive portion 133 and the sheet of paper being conveyed is set larger than the distance L1 between each first protrusive portion 135 and the recording medium being conveyed. With the setting, the sheet of paper is chiefly supported by the first protrusive portions 135 of the large protrusion amount, and the support by the second protrusive portions 133 is moderated as compared with the support by the first protrusive portions 135. Accordingly, the influence of the second protrusive portions 133 on the image formation on the sheet of paper can be restrained to the utmost. That is, even in the case of the occurrence of the very strong attraction as indicated by the two-dot chain line M in FIG. 12B, the support by the first protrusive portions 135 is chief, and abutment forces do not become very large as to the support by the second protrusive portions 133. Besides, regarding the weak attraction as in the conveyance sheet of paper 3' in the ordinary mode indicated by the dot-and-dash line N, the support by the first protrusive portions 135 suffices, and the sheet of paper is not supported by the second protrusive portions 133, so that the middle side of the sheet of paper in the widthwise direction thereof can be protected still more. Incidentally, the conveyance sheet of paper 3' of the maximum size (for example, A4-format) for use in the laser printer 1 is exemplified in FIGS. 12A and 12B, but sheets of paper having smaller sizes are also usable. In a case where such a smaller size is employed and where the size of the sheet of paper in the widthwise direction thereof is smaller than the interval between the end parts 135*b* and 135*b*, the occurrence of attraction is coped with in such a way that the sheet of paper is supported by only the second protrusive portions 133, without being supported by the first protrusive portions 135.

As shown in FIG. 11 and FIGS. 12A and 12B, the plurality of second protrusive portions 133 are disposed at a mutual interval in the widthwise direction of the sheet of paper being conveyed (in the Z-axial direction). According to the configuration, a plurality of support positions are established, so that the attraction of the sheet of paper can be suppressed more stably, and the second protrusive portions 133 are spaced in the widthwise direction, so that the influence on the image is suppressed more than in a case where the second protrusive portions 133 are continuously disposed. Since the second protrusive portions 133 are rectilinearly constructed along the paper conveyance direction, the influence on the image is reduced still further.

As shown in FIG. 13, the attraction suppression portion 130 is disposed upstream of the first electrically-conductive member 102 in the paper conveyance direction, so that the sheet of paper is smoothly conveyed, not only at the part where the first electrically-conductive member 102 is disposed, but also on the upstream side thereof (that is, in the region between the parts where the transfer roller 32 and the first electrically-conductive member 102 are disposed).

In the first embodiment, the attraction suppression portion 130 as described above is provided in the housing of the process cartridge 20, so that the attraction is effectively preventable in that housing (specifically, lower frame 28) of the process cartridge 20 which is near to the nip position (transfer position P1) between the photosensitive member 29 and the transfer roller 32 and which is more liable to cause the attraction phenomenon.

Figure 15:
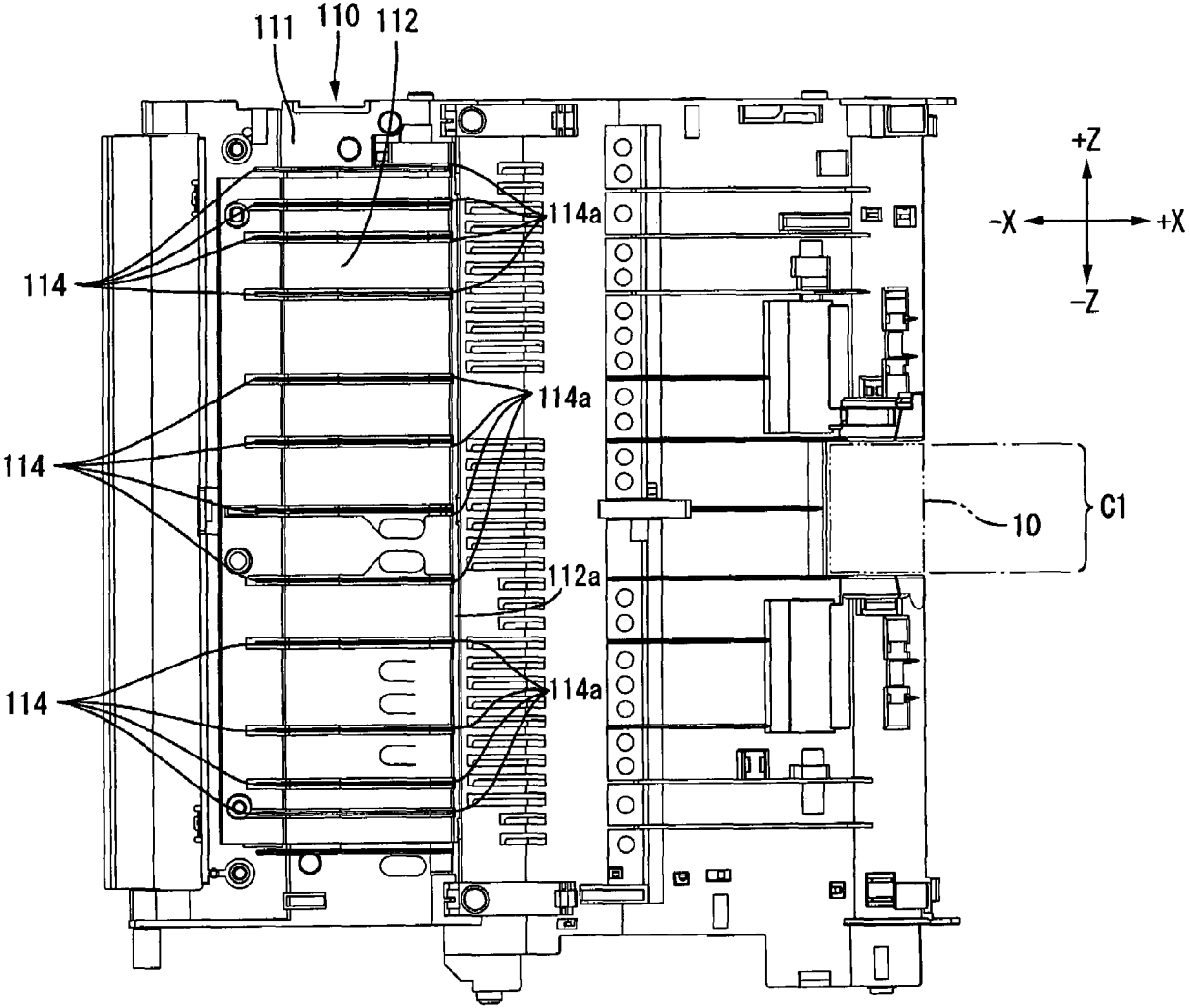
FIG. 15 is a plan view showing the guide member.
Figure 16:
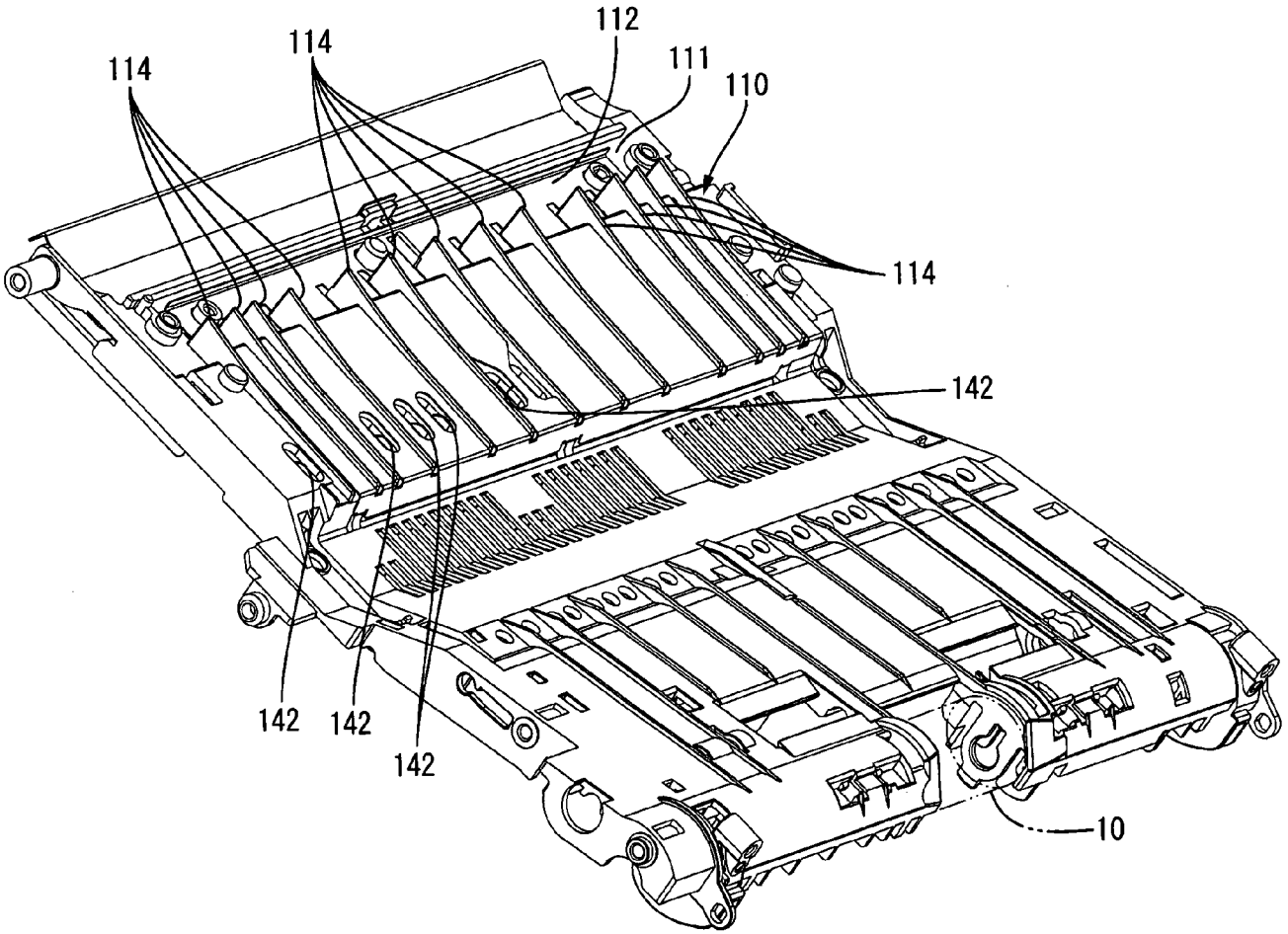
FIG. 16 is a perspective view showing the guide member.

The cleaning brush 33 is disposed in the process cartridge 20 as shown in FIGS. 1 and 9, and the paper powder having adhered to the photosensitive member 29 can be removed by the cleaning brush 33. In the first embodiment, in the process cartridge 20, the cleaning brush 33 and a housing part surrounding the cleaning brush 33 (the part of the lower frame 28 as surrounds the cleaning brush 33) are configured as a paper-powder removal device 160. As described above, the housing of the process cartridge 20 is constructed as part of the member on the image forming surface side. In this regard, as shown in FIG. 11 and the explanatory view of FIG. 14 (explanatory view for explaining part of FIG. 9 on enlarged scale and in rough-overview manner), a resin film 131 for receiving the paper powder is mounted on that part of the housing of the process cartridge 20 which corresponds to the feed roller 10 in the widthwise direction (Z-axial direction) of the conveyance sheet of paper 3' (FIG. 12(B)), in a state where the resin film 131 is partly protruded. By the way, in FIG. 11, the resin film 131 is indicated by hatching. As shown in FIGS. 15 and 16, the feed roller 10 is arranged over the predetermined range of the widthwise (Z-axial) middle part of the conveyance sheet of paper 3' (FIG. 12B), and the resin film 131 shown in FIG. 11 is arranged in substantially the same range as the range where the feed roller 10 is disposed (feed roller arrangement region C1), in the Z-axial direction. Incidentally, although the resin film 131 is arranged in substantially the same range as the feed roller arrangement region C1 in the Z-axial direction here, it may well be arranged over a region which includes the feed roller arrangement region C1 and which is somewhat larger than this region C1. Besides, as described above, the resin film 131 is arranged over the predetermined range of the widthwise (Z-axial) middle part of the conveyance sheet of paper 3' (FIG. 12B), but parts on both the sides of the resin film 131 as oppose to the conveyance sheet of paper 3' (parts of regions C2 and C3 in FIG. 11) are formed as non-arrangement regions in which the resin film is not arranged.

More specifically, when the resin film for preventing the paper powder from dropping is arranged at part of the paper-powder removal device 160 (concretely, at part of the lower frame 28), the paper powder can be effectively removed, but on the other hand, the charging of the resin film becomes a problem. However, when the resin film is arranged only at the part corresponding to the feed roller 10 liable to generate the paper powder, as in the above configuration, the paper powder can be effectively removed with the charging suppressed.

Figure 14:
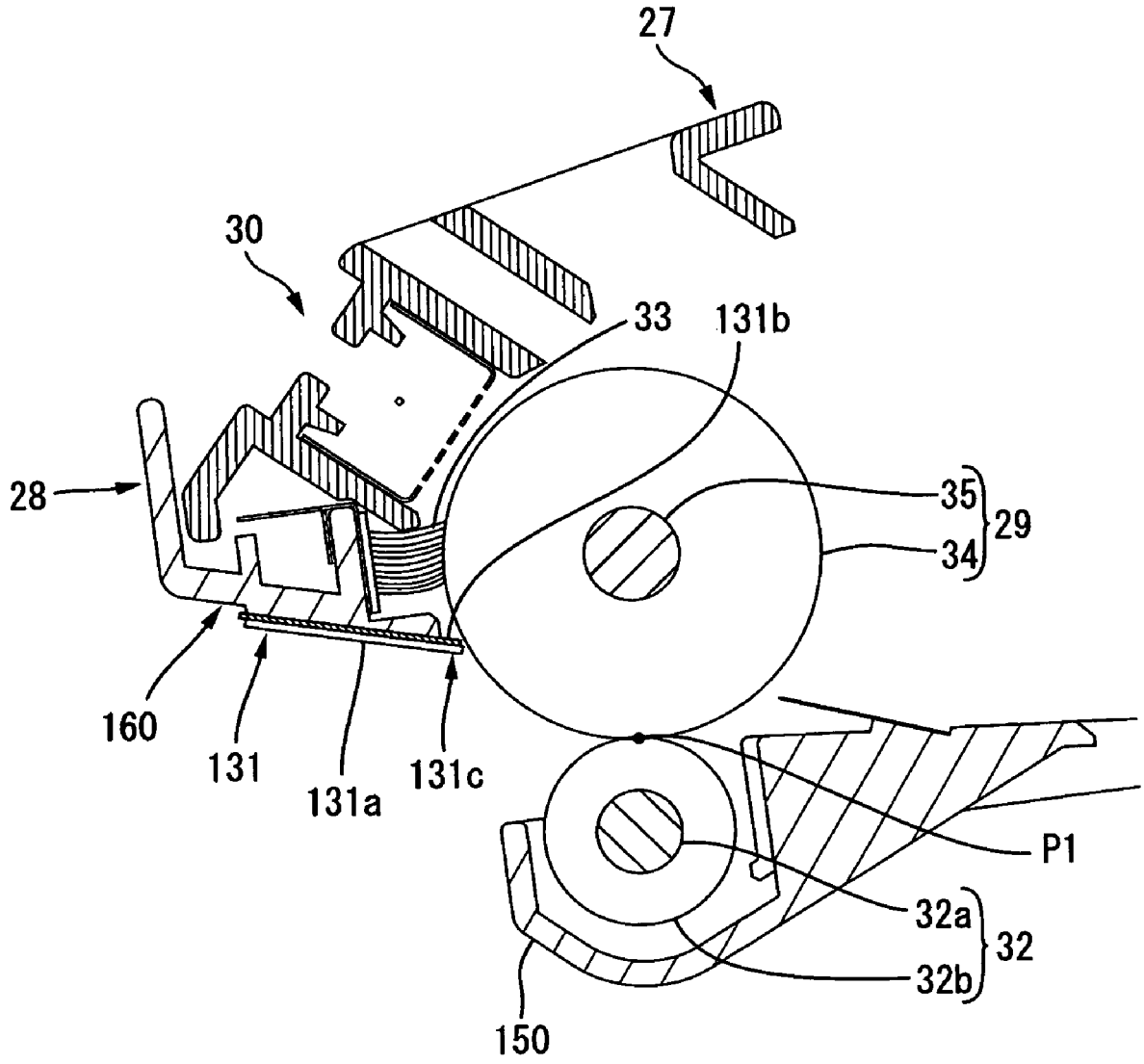
FIG. 14 is a model view showing part of FIG. 9 on enlarged scale and in rough-overview manner.

As shown in FIG. 14, the resin film 131 includes a film body 131*a* made of, for example, PET, and an adhesive layer 131*b*. In that protrusive portion 131*c* of the resin film 131 which protrudes from the housing (namely, the lower frame 28) of the paper-powder removal device 160, the adhesive layer 131*b* is exposed onto the side of the photosensitive member 29. According to this configuration, the effect of removing the paper powder can be more enhanced by the simple arrangement. More specifically, a sheet member (such as dual-side tape) both the surfaces of which are provided with an adhesive medium is disposed so as to cover the film body 131*a* as the adhesive layer 131*b*. One surface of the adhesive layer 131*b* is bonded with the film body 131*a*, while part of the other surface is bonded with the outer surface of the housing (namely, the lower frame 28). Besides, that part of the adhesive layer 131*b* which is not bonded with the housing (namely, that part of the adhesive layer 131*b* which lies at the protrusive portion 131*c* of the resin film 131) is exposed onto the side of the photosensitive member 29.

Next, the member provided on the side of the non-image-forming surface will be described.

Figure 17:
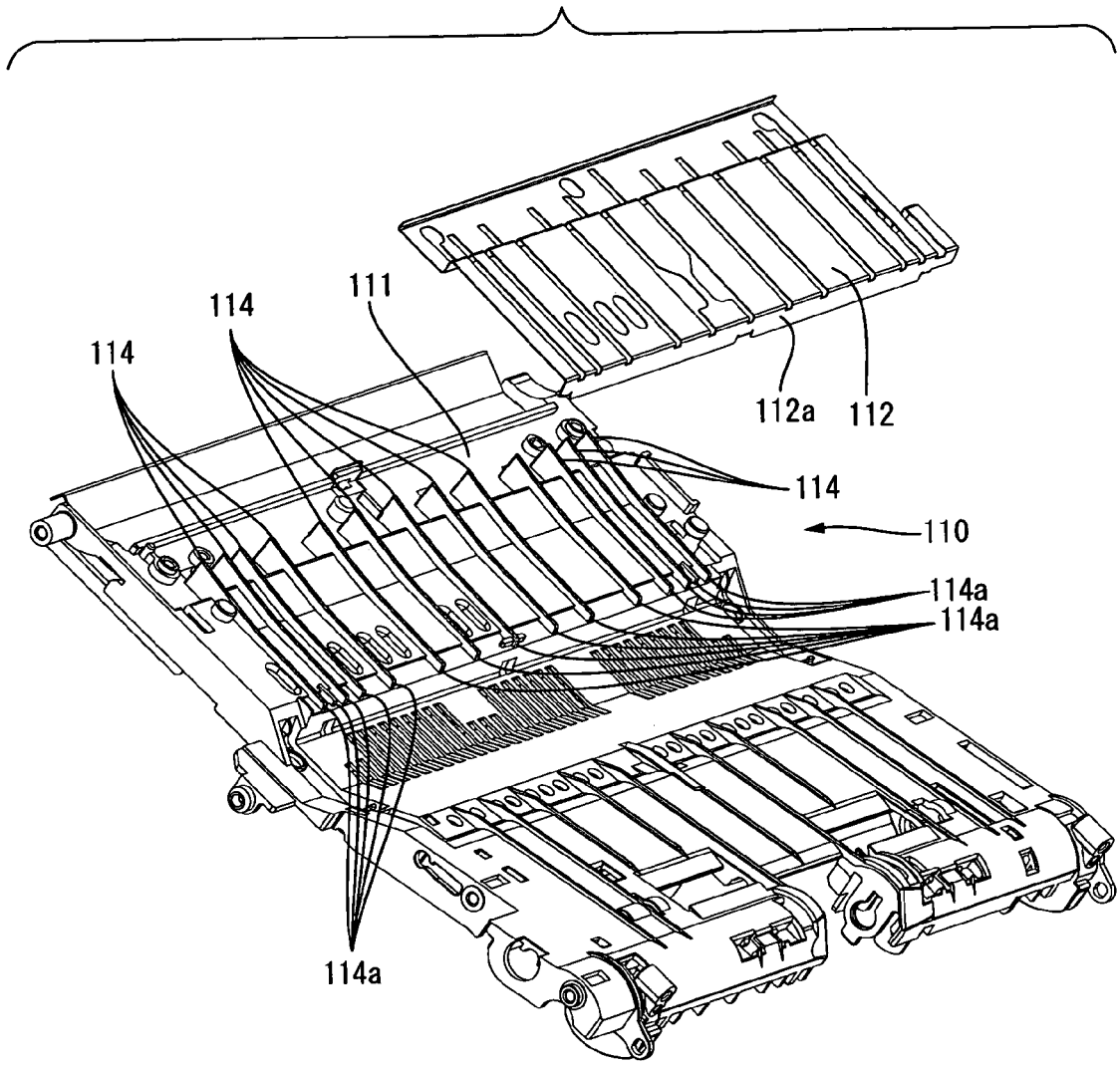
FIG. 17 is a perspective view showing a state where a second electrically-conductive member has been detached from the guide member.

FIG. 15 is a plan view exemplifying the guide member 110, and FIG. 16 is a perspective view corresponding to FIG. 15. FIG. 17 is a perspective view exemplifying a state where the second electrically-conductive member 112 has been detached from the guide member 110.

As stated before, in the laser printer 1 according to the first embodiment, the guide member 110 which corresponds to the member on the non-image-forming surface side is arranged in opposition so as to confront the non-image-forming surface of the conveyance sheet of paper 3' (FIG. 13). Further, the guide member 110 is provided with the second electrically-conductive member 112 exhibiting the electric conductivity and being grounded, as shown in FIGS. 15 through 17. The second electrically-conductive member 112 is made of a flat metal member (for example, a zinc-coated member prepared by zincking a stainless steel plate or an iron plate). This electrically-conductive member 112 is disposed so as to cover part of the outer surface of the guide member 110 (more concretely, so as to cover the outer surface of that member body portion 111 of the guide member 110 which is made of a non-electrically-conductive material). Besides, the second electrically-conductive member 112 is arranged so as to directly oppose to the non-image-forming surface (opposite to the image forming surface) of the conveyance sheet of paper 3' being conveyed (FIG. 13).

In the configuration of the first embodiment, the second electrically-conductive member 112 which is grounded is provided in the guide member 110 which is disposed on the side of the opposite surface to the image forming surface defined between the transfer roller 32 and the fixation portion 21. As regards the members constituting the conveyance path, therefore, the electric potential of the entirety of the second electrically-conductive member 112 and the guide member 100, being the member on the non-image-forming surface side, as combined can be approached to zero, not only on the image forming surface side, but also on the non-image-forming surface side. In the laser printer 1 of this embodiment, the transfer roller 32 is disposed on the side of the non-image-forming surface of the conveyance sheet of paper 3' (FIG. 13), so that the guide member 110 is easily charged in the same polarity as that of the transfer bias, and the behavior of the conveyance sheet of paper 3' (FIG. 13) is liable to become unstable. However, when the second electrically-conductive member 112 is grounded to zeroize the potential thereof, a potential difference is established between the conveyance sheet of paper 3' (FIG. 13) and the guide member 110 including the second electrically-conductive member 112, and the conveyance sheet of paper 3' is attracted, whereby the behavior of this conveyance sheet of paper can be stabilized. On this occasion, the non-image-forming surface side of the conveyance sheet of paper 3', is attracted, so that no influence is exerted on an image quality.

The guide member 110 extends from the transfer roller 32 toward the fixation portion 21, and it includes a plurality of guide ribs 114 extending along the conveyance direction. In the example of FIG. 15, the second electrically-conductive member 112 is disposed so that the upstream-side end portions 114*a* of the guide ribs and the upstream-side end part 112*a* of the second electrically-conductive member 112 may become substantially the same positions in the conveyance direction of the recording medium. The second electrically-conductive member 112, however, may well be disposed on a further upstream side relative to the upstream-side end portions of the guide ribs 114.

As shown in FIG. 13, part of the second electrically-conductive member 112 is arranged at a position opposing to the process cartridge 20. Thus, the sheet of paper 3 is located so as to smoothly pass between the process cartridge 20 and the guide member 110. Besides, the process cartridge 20 is provided with a transfer member accommodation portion 150 which surrounds the periphery of the transfer roller 32 so as to accommodate this transfer roller 32, and the second electrically-conductive member 112 is arranged in adjacency to the transfer member accommodation portion 150. In case of a configuration in which the transfer roller 32 is exposed onto the downstream side thereof, the second electrically-conductive member may well be disposed so as to adjoin the transfer roller 32. In the first embodiment, the second electrically-conductive member 112 is disposed at the position adjoining the transfer member accommodation portion 150, so that the stabilization of the behavior of the sheet of paper 3 is attained in the vicinity of the transfer roller 32, and the sheet of paper 3 is smoothly shifted from the transfer roller 32 to the guide member 110.

In the first embodiment, as shown in FIG. 13, the distance L3 between the first electrically-conductive member 102 and the sheet of paper 3 being conveyed (that is, the shortest distance from the first electrically-conductive member 102 to the conveyance sheet of paper 3') is set larger than the distance L4 between the second electrically-conductive member 112 and the sheet of paper 3 being conveyed (that is, the shortest distance from the second electrically-conductive member 112 to the conveyance sheet of paper 3'). With the setting, the second electrically-conductive member 112 is nearer to the conveyance sheet of paper 3' than the first electrically-conductive member 102, so that the sheet of paper 3 is more liable to be attracted on the side of the second electrically-conductive member 112 than on the side of the first electrically-conductive member 102. Accordingly, the image forming surface of the sheet of paper 3 is effectively protected, and the image quality can be held at a high precision. More specifically, the potential difference is established also between the conveyance sheet of paper 3' and the duct portion 100 including the first electrically-conductive member 102, by grounding this first electrically-conductive member 102. Therefore, when the distance L3 is set to be smaller than the distance L4, a force by which the first electrically-conductive member 102 attracts the conveyance sheet of paper 3' exceeds a force by which the second electrically-conductive member 112 attracts the conveyance sheet of paper 3', contrariwise to the above, and there occurs the drawback that the conveyance sheet of paper 3' is attracted to the duct portion 100. In contrast, in the configuration according to the first embodiment, such a drawback does not occur, and the behavior of the conveyance sheet of paper 3' becomes very stable.

Second Embodiment

Next, a laser printer according to a second embodiment will be described.

Figure 18:
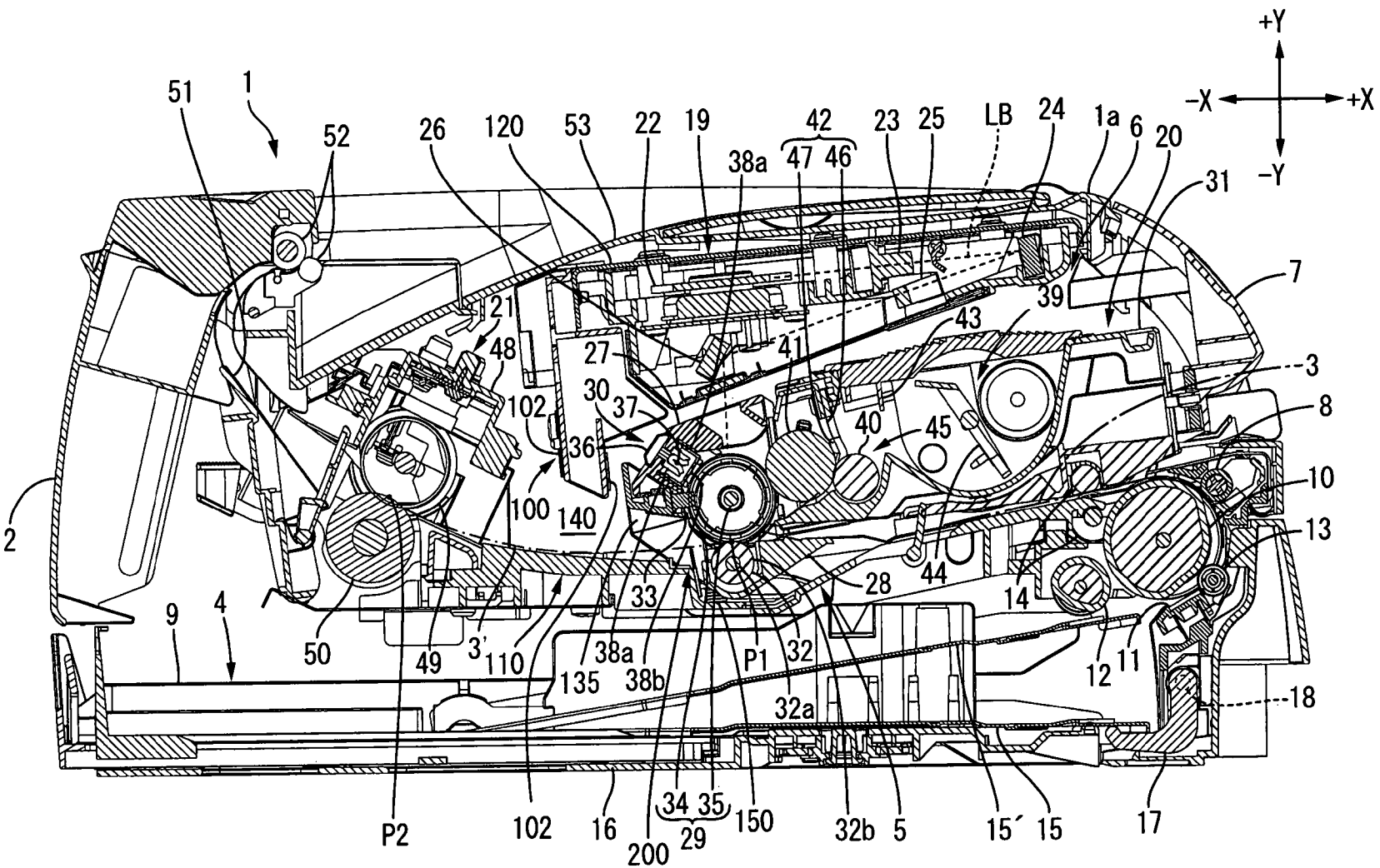
FIG. 18 is a side sectional view of essential portions exemplifying a laser printer according to a second embodiment.
Figure 19:
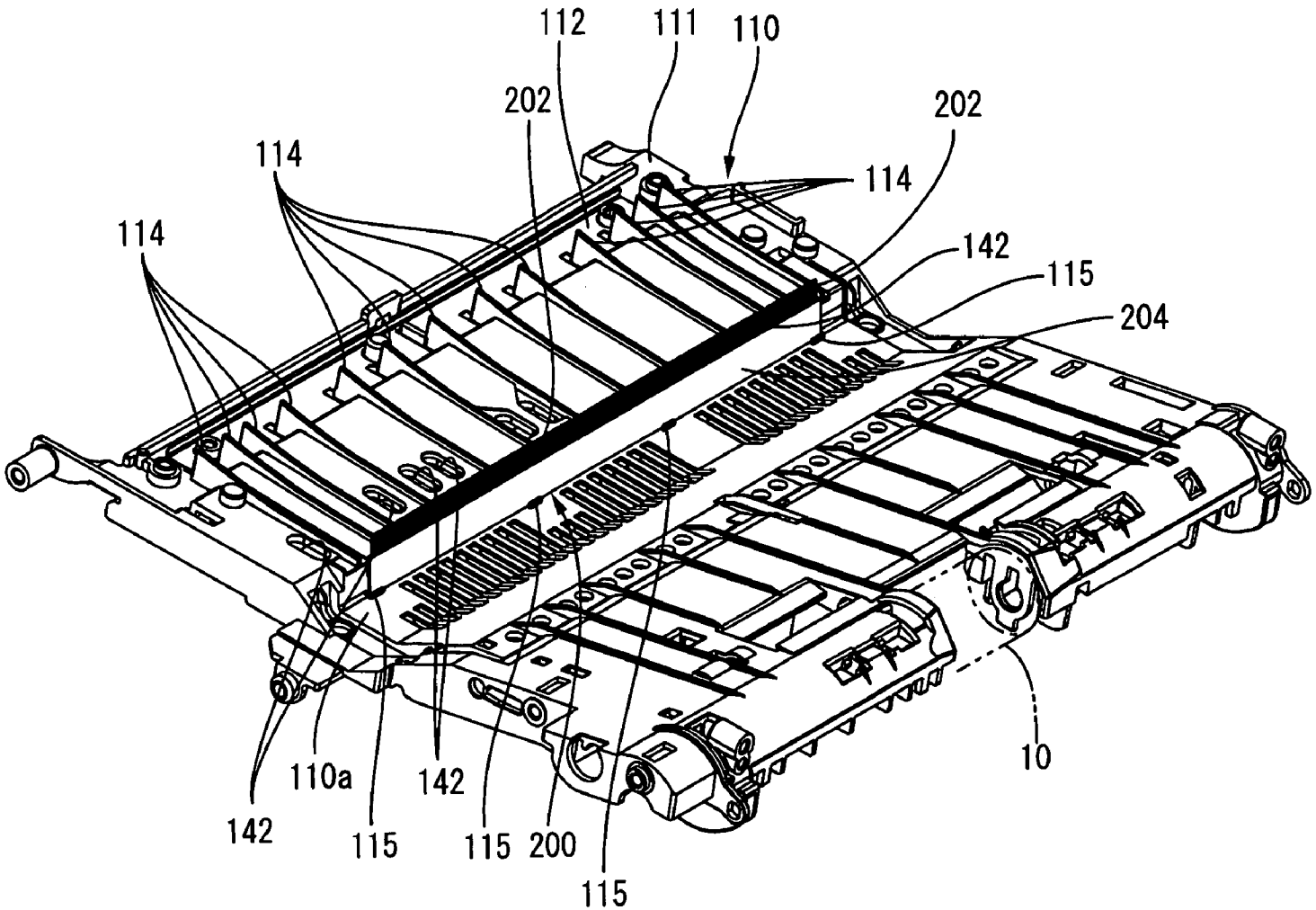
FIG. 19 is a perspective view showing the vicinity of a guide member which is employed in the laser printer in FIG. 18.
Figure 20:
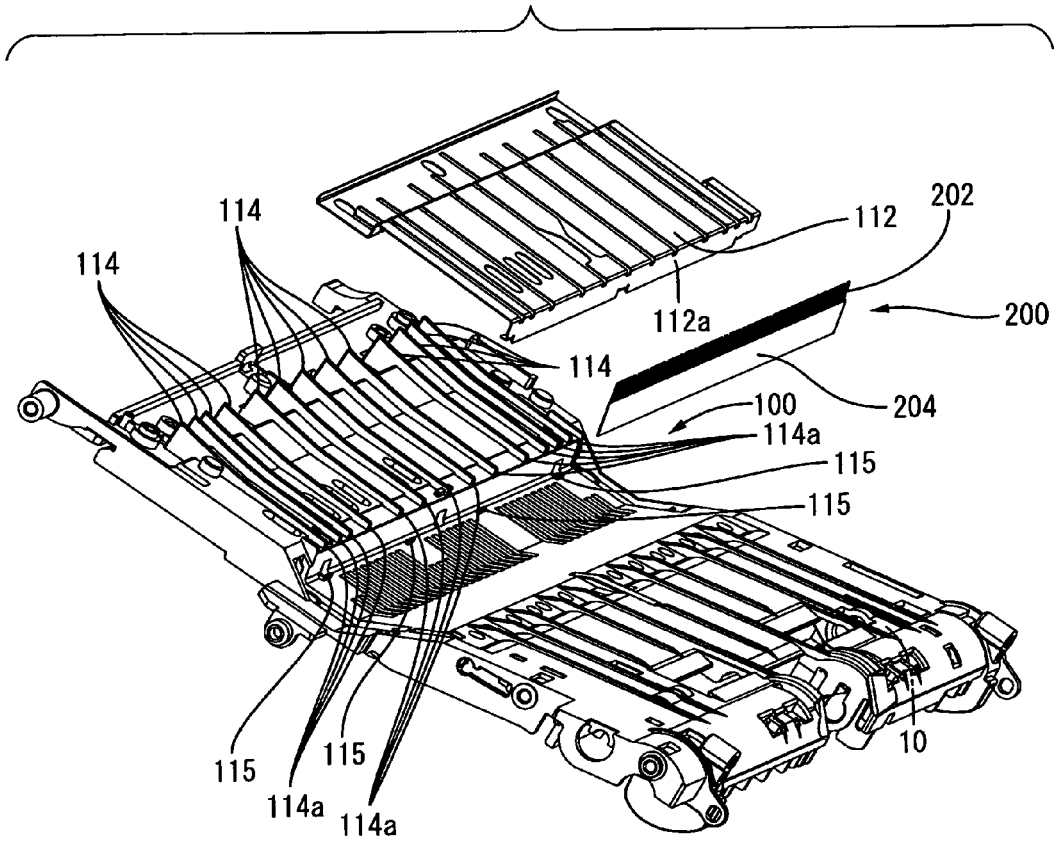
FIG. 20 is a perspective view showing a state where a second electrically-conductive member and a charge removal brush have been detached from the configuration in FIG. 19.
Figure 21:
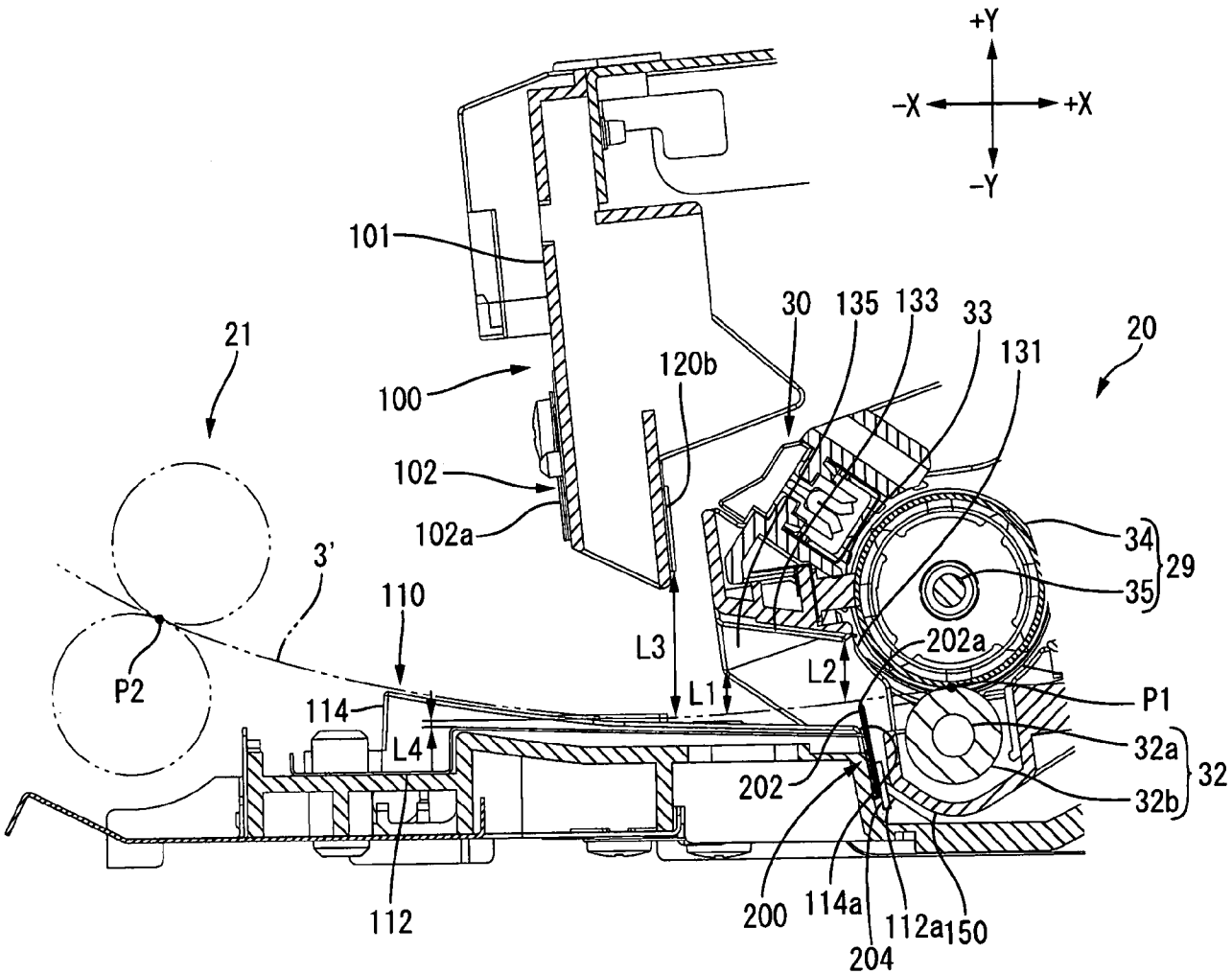
FIG. 21 shows a configuration obtained by modifying the configuration in FIG. 13, and is an enlarged view showing the sections of the essential portions of the laser printer in FIG. 18, on enlarged scale.
Figure 22:
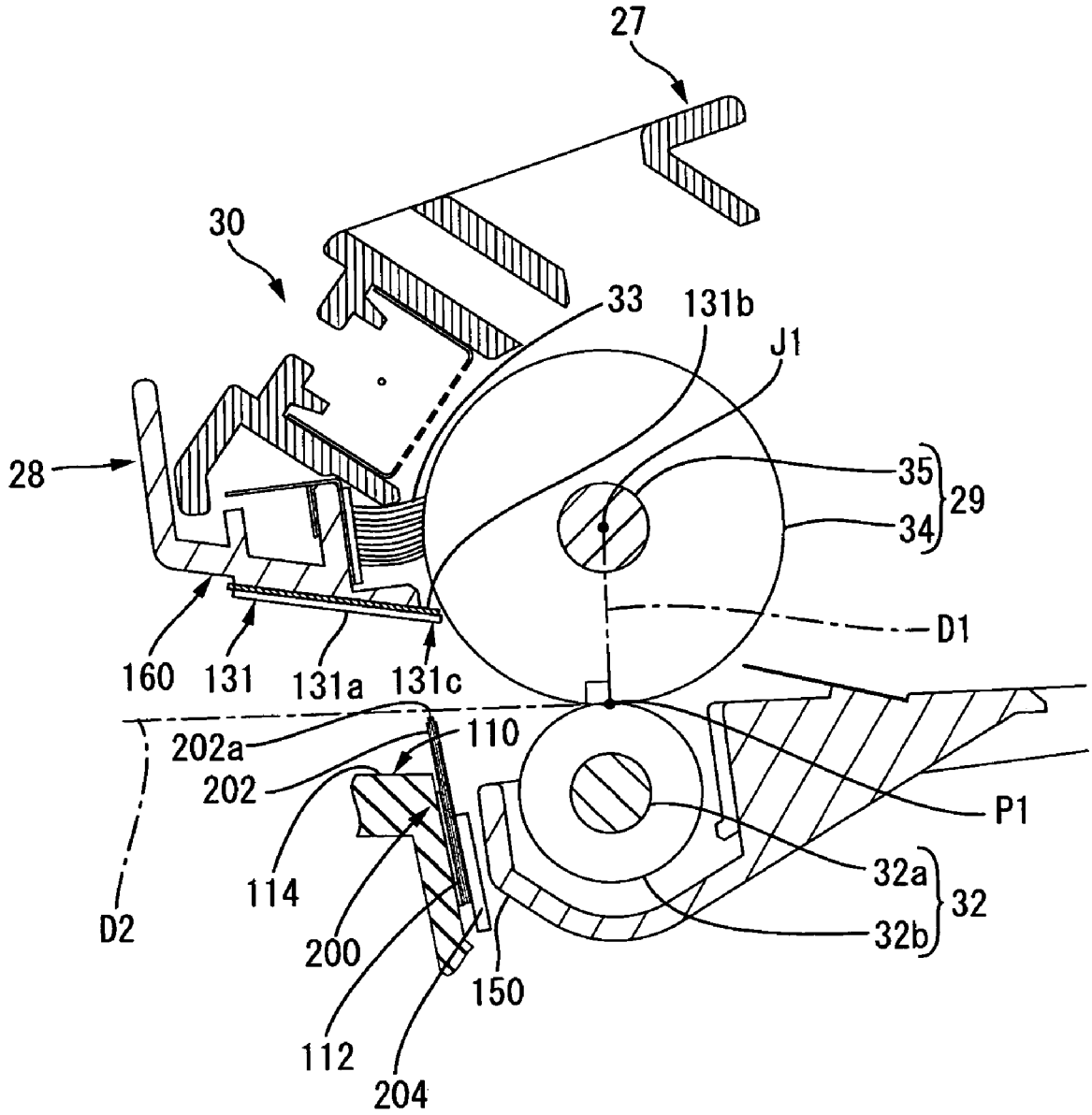
FIG. 22 shows a modification to the configuration in FIG. 14, and is an explanatory view for explaining the position of the charge removal brush in the laser printer in FIG. 18.

FIG. 18 is a side sectional view of essential portions exemplifying a laser printer according to second embodiment, and FIG. 19 is a perspective view showing the vicinity of a guide member which is employed in the laser printer in FIG. 18. FIG. 20 is a perspective view showing a state where a second electrically-conductive member 112 and a charge removal brush 200 have been detached from the configuration in FIG. 19. FIG. 21 shows a configuration into which the configuration in FIG. 13 as shown in first embodiment has been modified (that is, a configuration in which the charge removal brush 200 is attached to the configuration in FIG. 13, so as to correspond to the laser printer according to this embodiment), and it is an enlarged view showing the sections of the essential portions of the laser printer in FIG. 18, on enlarged scale. FIG. 22 shows a configuration into which the configuration in FIG. 14 as shown in first embodiment has been modified (that is, a configuration in which the charge removal brush 200 is attached to the configuration in FIG. 14, so as to correspond to the laser printer according to the second embodiment). FIG. 14 is an explanatory view for explaining the position of the charge removal brush 200 in the laser printer in FIG. 18.

The laser printer 1 in FIG. 18 as exemplified in the description of the second embodiment differs from the first embodiment in the point that the charge removal brush 200 being charge reduction member is connected to the second electrically-conductive member 112 by connection member having an electric conductivity (concretely, an electrically-conductive adhesive to be stated later), and the configuration of this laser printer except the charge removal brush 200 and the connection member is the same as in first embodiment. Accordingly, the same numerals and signs as in first embodiment are assigned to parts except the charge removal brush 200, and the parts shall be omitted from detailed description.

In the configuration according to the second embodiment, the charge removal brush 200 for reducing electric charges borne on a sheet of paper (a recording medium) is disposed between a transfer position P1 based on a transfer roller 32 being transfer member and a fixation portion 21 being fixation member, and at a position nearer to the transfer position P1 with respect to a first electrically-conductive member 102.

Also in the configuration according to the second embodiment, as in the first embodiment, a duct portion 100 (namely, a member on the side of the image forming surface of the sheet of paper) configured between the transfer roller 32 and the fixation portion 21 is provided with the first electrically-conductive member 102 which exhibits an electric conductivity and which is grounded, so that the potential of the duct portion 100 including the first electrically-conductive member 102 approaches to zero. Therefore, even when the duct portion 100 is arranged nearer to the sheet of paper being conveyed, due to the reduction of the size of the laser printer 1 (that is, even in a case where a small-sized configuration is formed as in the configuration according to this embodiment, or in a case where further reduction in size is achieved), the electric potential of the image forming surface side is controlled to be constant, and the behavior of the sheet of paper can be stabilized.

Especially in the image forming apparatus which employs an electrophotographic scheme as in the configuration according to this embodiment, a charger 30 is arranged on the image forming surface side of the sheet of paper being conveyed, and the transfer roller 32 is arranged on the non-image-forming surface side thereof. A bias which is opposite in polarity to a bias applied to the transfer roller 32 is usually applied to the charger 30 as in the configuration according to the second embodiment, so that the sheet of paper after the transfer of an image is liable to be attracted to the duct portion 100 being the member on the image forming surface side. In the configuration according to this embodiment, however, the first electrically-conductive member 102 is grounded to zeroize its potential, so that the potential difference between the sheet of paper being conveyed and the duct portion 100 including the first electrically-conductive member 102 is made small, and the attraction of the sheet of paper to the duct portion 100 is preventable.

In addition to such a configuration, the second embodiment is configured so that the potential difference between the sheet of paper being conveyed and the whole duct portion 100 including the first electrically-conductive member 102 can be made still smaller. More specifically, even when the potential in the vicinity of the duct portion 100 is substantially zeroized by disposing the first electrically-conductive member 102 as described above, a certain degree of potential difference is yet apprehended to occur between the sheet of paper and the duct portion 100 being the member on the image forming surface side, in a case where the sheet of paper bears a large quantity of charges. In contrast, in the configuration according to the second embodiment, the charges borne on the sheet of paper can be reduced by the charge removal brush 200 before the sheet of paper being conveyed reaches the vicinity of the duct portion 100, so that the potential difference between the sheet of paper and the duct portion 100 can be made still smaller, and the behavior of the recording medium being conveyed can be stabilized still more.

In the second embodiment, as in the first embodiment, in addition to the first electrically-conductive member 102, the second electrically-conductive member 112 which is grounded is disposed in a guide member 110 which is configured between the transfer roller 32 and the fixation portion 21 and which is a member on the non-image-forming surface side. Accordingly, not only on the image forming surface side, but also on the non-image-forming surface side, the potential of the entirety of the second electrically-conductive member 112 and the guide member 110 as combined can be approached to zero. Usually, in the image forming apparatus which employs the electrophotographic scheme as in the configuration according to the second embodiment, the transfer roller 32 is disposed on the side of the non-image-forming surface of the sheet of paper being conveyed, the guide member 110 being the member on the non-image-forming surface side is easily charged in the same polarity as that of the transfer bias, and the behavior of the sheet of paper being conveyed is liable to become unstable. In the second embodiment, however, a potential difference is generated between the sheet of paper being conveyed and the guide member 110 including the second electrically-conductive member 112, by grounding the second electrically-conductive member 112 and zeroizing the potential thereof, whereby the sheet of paper is attracted, and its behavior can be stabilized. As described above, the guide member 110 which extends from the transfer roller 32 toward the fixation portion 21 is disposed as the member on the non-image-forming surface side. In this regard, as shown in FIGS. 19 and 21, the guide member 110 is provided with a plurality of guide ribs 114 which extend along the conveyance direction of the sheet of paper, in the same manner as in the first embodiment.

On the other hand, with such a configuration, it is apprehended that the sheet of paper will come into strong touch with the guide ribs 114 of the guide member 110 when the second electrically-conductive member 112 attracts the sheet of paper to bring this sheet of paper into touch with the guide ribs 114. With the configuration in which the sheet of paper being conveyed come into strong touch with the guide ribs 114 in this manner, large vibrations are bestowed on the sheet of paper at the time of the touch, and hence, the developer image transferred on the sheet of paper is liable to be disordered. When the sheet of paper being conveyed comes into strong touch with the guide ribs 114, charges are removed from the sheet of paper at a stroke at the time of the touch, so that the developer image transferred on the sheet of paper is liable to be disordered. In the configuration according to the second embodiment, however, the arrangement capable of stabilizing the behavior of the sheet of paper is realized by the second electrically-conductive member 112, while at the same time, the charge removal brush 200 is disposed at the position which is further upstream of the upstream-side end portions 114*a* of the guide ribs 114 in the conveyance direction of the sheet of paper, so that the charges borne on the sheet of paper can be reduced to some degree by the charge removal brush 200 before the sheet of paper comes into touch with the guide ribs 114. Accordingly, the extent of the touch between the sheet of paper and the guide ribs 114 becomes very light, the shock (vibrations) and the sudden charge removal at the touch with the guide ribs 114 do not concur, and the disorder of the image at the touch with the guide ribs 114 is effectively preventable.

In the configuration according to the second embodiment, the charges are reduced to some degree by the charge removal brush 200 before the sheet of paper reaches the vicinity of the second electrically-conductive member 112, but the charges are not completely removed by the charge removal brush 200. Therefore, even after the sheet of paper has passed through the vicinity of the charge removal brush 200, a certain amount of charges remain on the sheet of paper. Accordingly, a certain potential difference is established by the remaining charges and the guide member 110 including the second electrically-conductive member 112, which is kept at the zero level, and the function of attracting the sheet of paper is fulfilled by the guide member 110 including the second electrically-conductive member 112.

Next, the charge removal brush 200 will be described in detail.

As shown in FIG. 19, the charge removal brush 200 includes a flat holder plate 204 which is made of a resin material (for example, PET material), and a plurality of filamentous portions 202 which are made of an electrically-conductive fibrous material (for example, an organic electrically-conductive fiber in which copper sulfide or the like is chemically bonded with a acrylic fiber, a Nylon fiber or the like) and which are mounted on the holder plate 204. The filamentous portions 202 are respectively bonded to the holder plate 204 so that their lower ends may lie below the center of the holder plate 204. The arrangement region of the filamentous portions 202 is defined over a predetermined region in the widthwise direction of the sheet of paper, and a recording medium opposition portion opposing to the sheet of paper is formed by the plurality of filamentous portions 202. In the second embodiment, the recording medium opposition portion is formed over the whole width of an image-formable region in the sheet of paper.

As shown in FIGS. 19 and 20, the plurality of filamentous portions 202 in the above charge removal brush 200 are connected to the second electrically-conductive member 112 by an electrically-conductive adhesive, on their sides opposite to is their sides on which they are bonded to the holder plate 204. That is, in this configuration, the plurality of portions 202 of the electrically-conductive fibrous material as constitute the recording medium opposition portion are connected to the second electrically-conductive member 112 by the electrically-conductive adhesive, so that the charges of the sheet of paper are efficiently reduced. Incidentally, the "electrically-conductive adhesive" corresponds to "connection member having an electric conductivity". Also, the "second electrically-conductive member" corresponds to "ground member". The electrically-conductive adhesive usable is, for example, an adhesive made of a pasty electrically-conductive resin in which the electrically-conductive particles of gold, silver, nickel, carbon or the like are compounded with an epoxy resin or the like resin as a base, but any other adhesive may well be employed as long as it has an electric conductivity and functions as a bonding medium.

As shown in FIG. 21, the charge removal brush 200 is disposed at a position at which it is capable of touching the sheet of paper being conveyed (conveyance sheet of paper 3') (in other words, at a position at which part of the brush 200 is located on the traveling path of the conveyance sheet of paper 3'). Concretely, as shown in FIG. 22, the distal end 202*a* of the charge removal brush 200 is located at a position which coincides with an orthogonal plane D2 that is orthogonal to a plane D1 connecting the transfer position P1 and the rotating axis J1 of the photosensitive member 29, and that passes through the transfer position P1. In this configuration, the charge removal brush 200 is arranged so as not to widely intersect an extension direction in which the sheet of paper extends from the transfer position P1, so that the sheet of paper is less liable to undergo a shock in the charge reduction mode. Incidentally, the distal end 202*a* of the charge removal brush 200 may well be located at a position which is slightly downwardly spaced from the orthogonal plane D2 which is orthogonal to the plane D1 connecting the transfer position P1 and the rotating axis J1 of the photosensitive member 29.

As shown in FIG. 21, the charge removal brush 200 is disposed so as to protrude in a direction intersecting the conveyance path of the sheet of paper (the path of the conveyance sheet of paper 3'). When, in this manner, the charge removal brush 200 is disposed so as to protrude in the direction intersecting the conveyance path, a time period for which the charge removal brush 200 opposes to the sheet of paper becomes shorter per unit area thereof, than in a configuration in which the charge removal brush 200 is arranged so as to extend along the conveyance path. Accordingly, while the charges can be reduced to some degree, they are difficult to be removed very suddenly.

As shown in FIG. 19, the guide member 110 includes positioning portions 115 which position the charge removal brush 200. The positioning portions 115 are constructed as projections which project in the bottom surface 110*a* of the guide member 110. As shown in FIGS. 19 and 20, the positioning portions 115 support the lower end part of the holder plate 204 in the charge removal brush 200, thereby to repress the downward movement of the holder plate 204 relative to the guide member 110. As a result, the charge removal brush 200 is stably positioned to the guide member 110. Accordingly, the charge removal brush 200 and the sheet of paper which is conveyed while being guided by the guide member 110 can be prevented from becoming excessively distant or coming into excessive touch, and the charges can be stably reduced from the sheet of paper. Moreover, a mounting error in the case of mounting the charge removal brush 200 on the apparatus can be mitigated.

Other Embodiments

The present invention is not limited to the embodiments described above with reference to the drawings, but embodiments to be stated below by way of example shall also be covered within the technical scope of the invention, and the invention can further be variously altered and carried out within a scope not departing from the purport thereof, otherwise than the ensuing description.

(1) In each of the embodiments, the first electrically-conductive member 102 has been disposed in the duct portion 100, but it may well be disposed in any member other than the duct portion 100.

(2) In each of the embodiments, the first electrically-conductive member 102 has been constructed of the flat metal member, but it may well have any other configuration. The first electrically-conductive member may well be constructed of, for example, a resin member having an electric conductivity. Likewise, the second electrically-conductive member may well be constructed of any member other than the flat metal member (of, for example, a resin member having an electric conductivity.)

(3) In each of the embodiments, the first electrically-conductive member 102 is formed so as to extend orthogonally to the plane of the conveyance sheet of paper 3', by covering the duct body 101 of the duct portion 100 with this first electrically-conductive member 102, but any other configuration may well be employed. By way of example, the first electrically-conductive member 102 may well be disposed so as to become parallel to the plane of the conveyance sheet of paper 3', and it may well be arranged so as to incline relative to the plane of the conveyance sheet of paper 3'.

(4) Incidentally, regarding the configuration of the first protrusive portions 135 and the second protrusive portions 133 which constitute the attraction suppression portion 130, the peculiar effect of suppressing the attraction of the sheet of paper is achieved even by a configuration in which the first electrically-conductive member 102 is not disposed (that is, a configuration in which the member 100 on the image forming surface side is not grounded), and a synergetic effect can be expected owing to the coexistence of the attraction suppression portion 130 and the first electrically-conductive member 102.

(5) In second embodiment, the charge removal brush which includes the plurality of filamentous portions constructed in the shape of the brush has been exemplified as the charge reduction member, but the charge reduction member may well be constructed of a charge removal plate of metal material or the like in which a plurality of tip portions are arrayed in the widthwise direction of the plate.

(6) In each of the first and the second embodiments, the image forming apparatus in which the first electrically-conductive member and the second electrically-conductive member are both disposed has been exemplified, but it is also allowed to employ a different configuration in which only the first electrically-conductive member is disposed without disposing the second electrically-conductive member. Besides, second embodiment has exemplified the configuration in which the charge reduction member is further disposed in the image forming apparatus provided with both the first electrically-conductive member and the second electrically-conductive member, but the charge reduction member may well be disposed in a configuration in which only the first electrically-conductive member is disposed without disposing the second electrically-conductive member.

What is claimed is:

1. An image forming apparatus comprising:

an image carrier that carries a developer image;

a transfer member that transfers the developer image carried on the image carrier onto an image forming surface of a recording medium being conveyed;

a fixation member that is disposed downstream of the transfer member in a conveyance direction of the recording medium, and fixes the developer image transferred on the recording medium;

a first member that is disposed between the transfer member and the fixation member to face the image forming surface of the recording medium; and a second member including a guide member extending from the transfer member toward the fixation member and being disposed between the transfer member and the fixation member to face a non-image forming surface that is opposite the image forming surface, wherein the first and second members are provided with first and second electrically-conductive members, respectively, each electrically-conductive member being grounded, and wherein the guide member is provided with a plurality of guide ribs that extend in the conveyance direction, the plurality of guide ribs are arranged so as to space the recording medium from the second electrically-conductive member at a distance that is less than a distance between the first electrically-conductive member and the recording medium.

2. The image forming apparatus according to claim 1, wherein the first electrically-conductive member is disposed so as to directly oppose to the recording medium.

3. The image forming apparatus according to claim 1, wherein the first electrically-conductive member is disposed so as to cover at least part of an outer surface of the first member.

4. The image forming apparatus according to claim 1, further comprising a duct portion that exhausts air within the image forming apparatus to exterior of the image forming apparatus, wherein at least part of the first member is formed by the duct portion, and wherein the first electrically-conductive member is disposed in the duct portion.

5. The image forming apparatus according to claim 4, further comprising a charger that charges the image carrier, wherein the duct portion exhausts air within the charger.

6. The image forming apparatus according to claim 1, wherein the first member is provided with an attraction suppression portion that suppresses a rear end part of the recording medium having passed through a transfer position of the transfer member from being attracted onto a side of the first member by abutting the rear end part of the recording medium, the attraction suppression portion being provided downstream of the transfer position in the conveyance direction of the recording medium.

7. The image forming apparatus according to claim 6, wherein the attraction suppression portion is provided with first protrusive portions that protrude in a direction opposing to the recording medium, the first protrusive portions being provided at positions oppose to both widthwise end portions of the recording medium.

8. The image forming apparatus according to claim 7, wherein the first protrusive portions protrude having protrusion amounts that gradually become smaller from the widthwise end portions of the recording medium to a middle portion of the recording medium.

9. The image forming apparatus according to claim 7, wherein each of the first protrusive portions includes a slant surface that faces the recording medium and formed so as to incline relative to the image forming surface of the recording medium, and wherein the slant surface is formed so as to gradually come near to the recording medium, toward the downstream side in the conveyance direction and toward the widthwise end portions of the recording medium.

10. The image forming apparatus according to claim 7, wherein the attraction suppression portion includes a second protrusive portion that is formed in a rib-like shape and extends in the conveyance direction of the recording medium, the second protrusive portion being provided at a position oppose to middle portion of the recording medium.

11. The image forming apparatus according to claim 10, wherein a distance between the second protrusive portion and the recording medium is set to be smaller than a distance between each of the first protrusive portions and the recording medium.

12. The image forming apparatus according to claim 10, wherein the attraction suppression portion is provided with a plurality of the second protrusive portions and wherein the plurality of second protrusive portions are provided at a mutual interval in widthwise direction of the recording medium.

13. The image forming apparatus according to claim 10, wherein the second protrusive portion is formed to be rectilinear along the conveyance direction of the recording medium.

14. The image forming apparatus according to claim 6, wherein the attraction suppression portion is disposed upstream of the first electrically-conductive member in the conveyance direction of the recording member.

15. The image forming apparatus according to claim 6, further comprising a process cartridge that is provided with the image carrier, and configured to be detachably attached to the image forming apparatus, wherein a part of the process cartridge is configured to form at least a part of the first member, and wherein the attraction suppression portion is provided on a housing of the process cartridge.

16. The image forming apparatus according to claim 1, further comprising:

a feed roller that is rotatably provided and feeds the recording medium in abutment thereon; and a paper-powder removal device that removes paper powder adherent on the image carrier, wherein a housing of the paper-powder removal device is configured to form at least a part of the first member, and wherein the paper-powder removal device is provided with a resin film on the housing thereof to partially protrude from the paper-powder removal device at a part that corresponds to the feed roller in a widthwise direction of the recording medium, the resin film receiving the paper powder.

17. The image forming apparatus according to claim 16, wherein the resin film is provided with an adhesive layer that is disposed at a protrusive portion of the resin film, the protrusive portion protruding from the housing of the paper-powder removal device.

18. The image forming apparatus according to claim 1, wherein the second electrically-conductive member is disposed so as to directly oppose to the recording medium.

19. The image forming apparatus according to claim 1, wherein the second electrically-conductive member is disposed between the guide ribs along the conveyance direction such that at least a portion of the second electrically-conductive member is provided at a position upstream of upstream-side end portions of the guide ribs in the conveyance direction of the recording medium.

20. The image forming apparatus according to claim 1, further comprising a process cartridge that is provided with the image carrier, and configured to be detachably attached to the image forming apparatus, wherein a part of the process cartridge is configured to form at least a part of the first member, and wherein at least a part of the second electrically-conductive member is arranged at a position opposite to the process cartridge.

21. The image forming apparatus according to claim 1, further comprising a transfer member accommodation portion that accommodates the transfer member therein, wherein the second electrically-conductive member is arranged to be adjacent to at least one of the transfer member and the transfer member accommodation portion.

22. The image forming apparatus according to claim 1, wherein the second electrically-conductive member is made of a flat metal member.

23. The image forming apparatus according to claim 1, characterized in that the first electrically-conductive member is made of a flat metal member.

24. The image forming apparatus according to claim 1, further comprising a charge reduction member that reduces electric charges borne on the recording medium, the charge reduction member being provided at a position between the fixation member and a transfer position of the transfer member, the position being nearer to the transfer position than the first electrically-conductive member.

25. The image forming apparatus according to claim 24, wherein the charge reduction member is provided at a position where the charge reduction member is touchable with the recording medium.

26. The image forming apparatus according to claim 24, wherein the image carrier is configured to be rotatable, wherein the transfer member is arranged to oppose to an outer peripheral surface of the image carrier, wherein a position where the transfer member opposes to the image carrier is configured as the transfer position, and wherein a distal end of the charge reduction member is disposed at a position that coincides with an orthogonal plane that is orthogonal to a plane connecting the transfer position and a rotating axis of the image carrier and that passes through the transfer position, or at a position that is spaced apart from the orthogonal plane.

27. The image forming apparatus according to claim 24, wherein the charge reduction member is disposed so as to protrude in a direction that intersects a conveyance path of the recording medium.

28. The image forming apparatus according to claim 24, wherein the charge reduction member includes a recording medium opposition portion that opposes to the recording medium and provided with at least one of a plurality of filamentous portions and a plurality of tip portions.

29. The image forming apparatus according to claim 28, further comprising:

a ground member that is grounded; and a connection member that has an electric conductivity and connects the recording medium opposition portion to the ground member.

30. The image forming apparatus according to claim 24, wherein the second member is provided with a second electrically-conductive member that has an electric conductivity and being grounded, and a guide member that extends from the transfer member toward the fixation member, wherein the guide member is provided with a plurality of guide ribs that extend along the conveyance direction of the recording medium, and wherein the charge reduction member is provided at a position upstream of upstream-side end portions of the guide ribs in the conveyance direction of the recording medium.

31. The image forming apparatus according to claim 24, wherein the second member is provided with a second electrically-conductive member that has an electric conductivity and being is grounded, and wherein the charge reduction member is attached to the second electrically-conductive member.

32. The image forming apparatus according to claim 24, wherein the second member is provided with a guide member that extends from the transfer member toward the fixation member, and wherein the guide member is provided with positioning portions that position the charge reduction member.

* * * * *